US010073381B2

(12) United States Patent
Sato et al.

(10) Patent No.: US 10,073,381 B2
(45) Date of Patent: Sep. 11, 2018

(54) IMAGE FORMING DEVICE HAVING TONER UNIT, DEVELOPER UNIT, AND IMAGE BEARING UNIT

(71) Applicants: Shougo Sato, Seto (JP); Tsutomu Suzuki, Moriyama-ku (JP); Masahiro Ishii, Nagoya (JP)

(72) Inventors: Shougo Sato, Seto (JP); Tsutomu Suzuki, Moriyama-ku (JP); Masahiro Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/930,203

(22) Filed: Jun. 28, 2013

(65) Prior Publication Data

US 2013/0302067 A1 Nov. 14, 2013

Related U.S. Application Data

(63) Continuation of application No. 11/666,604, filed as application No. PCT/JP2005/019313 on Oct. 20, 2005, now Pat. No. 8,478,163.

(30) Foreign Application Priority Data

Oct. 29, 2004 (JP) ..... 2004-315768

(51) Int. Cl.

| | |
|---|---|
| ***G03G 21/18*** | (2006.01) |
| ***G03G 15/08*** | (2006.01) |
| ***G03G 21/16*** | (2006.01) |

(52) U.S. Cl.

CPC ..... *G03G 15/0889* (2013.01); *G03G 15/0872* (2013.01); *G03G 15/0891* (2013.01);

(Continued)

(58) Field of Classification Search

CPC ..... G03G 15/0872; G03G 21/1846; G03G 21/1853; G03G 2215/066; G03G 21/1821

(Continued)

(56) References Cited

U.S. PATENT DOCUMENTS 5,331,378 A * 7/1994 Baker et al. ..... 399/111
5,369,479 A 11/1994 Tsuyuki (Continued)

FOREIGN PATENT DOCUMENTS

EP 1191409 3/2002
JP 03-256056 B2 11/1991

(Continued)

OTHER PUBLICATIONS

Chinese Office Action dated May 23, 2008 on Application No. CN200580037387.7.

(Continued)

*Primary Examiner* — Benjamin Schmitt
*Assistant Examiner* — Milton Gonzalez
(74) *Attorney, Agent, or Firm* — Banner & Witcoff, Ltd.

(57) ABSTRACT

In the image forming device, the main body has a loading port. The image bearing unit is configured to be detachably attached to the main body thorough the loading port. The toner unit is configured to be detachably attached to the main body thorough the loading port. The developer unit is configured to be detachably attached to the main body thorough the loading port. The toner unit, the developer unit, and the image bearing unit are located in this order from the loading port to an inside of the main body, when the toner unit, the developer unit, and the image bearing unit are attached in the main body. The toner unit is configured to be independently detached from the main body, when the image bearing unit and the developer unit are attached to the main body.

14 Claims, 23 Drawing Sheets

(52) U.S. Cl.
CPC ..... *G03G 21/1633* (2013.01); *G03G 21/1821* (2013.01); *G03G 21/1846* (2013.01); *G03G 2215/066* (2013.01); *G03G 2221/163* (2013.01); *G03G 2221/18* (2013.01); *G03G 2221/183* (2013.01)

(58) Field of Classification Search
USPC ..... 399/111, 113
See application file for complete search history.

(56) References Cited

U.S. PATENT DOCUMENTS

| | | | | |
|---|---|---|---|---|
| 5,398,098 | A | 3/1995 | Fukunaga et al. | |
| 5,608,501 | A | 3/1997 | Makino | |
| 5,907,757 | A * | 5/1999 | Suzuki | |
| 6,389,243 | B2 * | 5/2002 | Makino | |
| 6,463,232 | B1 | 10/2002 | Kawai et al. | |
| 6,501,933 | B2 * | 12/2002 | Ishii | |
| 6,678,489 | B1 * | 1/2004 | Carter | G03G 21/1821 399/113 |
| 2003/0049046 | A1 | 3/2003 | Okabe | |
| 2003/0118366 | A1 | 6/2003 | Nukada et al. | |
| 2003/0118368 | A1 | 6/2003 | Saito et al. | |
| 2004/0037592 | A1 | 2/2004 | Hiura et al. | |
| 2004/0042817 | A1 | 3/2004 | Mori | |
| 2004/0184834 | A1 * | 9/2004 | Blaine et al. | 399/113 |
| 2004/0190934 | A1 | 9/2004 | Okabe | |

FOREIGN PATENT DOCUMENTS

| | | | |
|---|---|---|---|
| JP | 04-322260 | A | 11/1992 |
| JP | 05-035002 | | 2/1993 |
| JP | 05035002 | A * | 2/1993 |
| JP | 06-035244 | A | 2/1994 |
| JP | 06-035321 | A | 2/1994 |
| JP | 06035321 | A * | 2/1994 |
| JP | 06-075440 | | 3/1994 |
| JP | 06-110262 | | 4/1994 |
| JP | 06-222628 | A | 8/1994 |
| JP | 07-072779 | A | 3/1995 |
| JP | 07-181770 | | 7/1995 |
| JP | 07271162 | A * | 10/1995 |
| JP | 08015971 | A * | 1/1996 |
| JP | 08016062 | A * | 1/1996 |
| JP | 09-081000 | | 3/1997 |
| JP | 09080992 | A * | 3/1997 |
| JP | 11-272054 | A | 10/1999 |
| JP | 2000-267547 | A | 9/2000 |
| JP | 2001-188457 | A | 7/2001 |
| JP | 2002-108170 | A | 4/2002 |
| JP | 2004-021059 | A | 1/2004 |

OTHER PUBLICATIONS

Extended European Search Report for European Application No. 05795855.5 dated May 26, 2011.
Non-Final Office Action received in corresponding U.S. Appl. No. 11/666,604, dated Feb. 2, 2012.
Final Office Action received in corresponding U.S. Appl. No. 11/666,604, dated Oct. 19, 2012.
Notice of Allowance issued in corresponding U.S. Appl. No. 11/666,604, dated Mar. 4, 2013.
Nov. 25, 2014—(EP) Extended European Search Report for application No. 14176689.9.

* cited by examiner

IMAGE FORMING DEVICE HAVING TONER UNIT, DEVELOPER UNIT, AND IMAGE BEARING UNIT

This application is a continuation of U.S. application Ser. No. 11/666,604, filed Apr. 30, 2007, which is a national stage application based on PCT application No. PCT/JP2005/019313 filed Oct. 20, 2005, which claims priority from Japanese Patent Application Nos. 2004-315768 filed Oct. 29, 2004. The entire contents of the above noted applications are incorporated herein by reference.

TECHNICAL FIELD

The present invention relates to an image forming device of a so-called electrophotographic system which forms an image by developing an electrostatic latent image formed on a photosensitive member with toner and adhering the image on paper. The present invention also relates to a toner cartridge, a developer cartridge, and an image bearing member cartridge which can be used in the image forming device.

BACKGROUND ART

There is known an image forming device including a photosensitive member cartridge, a toner cartridge, and a developing cartridge, in a removable manner. The photosensitive member cartridge contains a photosensitive member. The toner cartridge contains toner. The developing cartridge contains a developing unit which develops an electrostatic latent image formed on the photosensitive member with the toner contained in the toner cartridge. In the image forming device of this kind, when an electrostatic latent image is formed on the photosensitive member, the electrostatic latent image is developed by the developing unit by using the toner contained in the toner cartridge. Then, the toner is adhered to paper, and thereby the image can be formed on the paper.

Here, in a certain kind of image forming device, for example, life of each of the units is different among each other, i.e. life of the photosensitive member is for 50000 sheets, whereas life of the developing unit is for 20000 sheets and life of the toner cartridge is for 3000 sheets. When the photosensitive member cartridge, the developing cartridge, and the toner cartridge are integrated together and exchanged at the same time, cost effectiveness is lowered. Accordingly, each of the cartridges has suggested to be made separable from the other cartridges so that only the cartridge reaching to the end of life is exchanged at a time (for example, refer to Patent Document 1).

Patent Document 1: Japanese Patent Application Publication No. H04-322260

SUMMARY

However, in the device disclosed in the Publication, a path of mounting and removing each of the cartridges, that is, a spatial path through which each of the cartridges passes at the time of being mounted and removed, is different from the passes of other cartridges. Therefore, a configuration of the device is complicated in order to mount and remove the cartridges. For example, a cover needs to be opened widely. As described above, the conventional devices cannot achieve the size reduction or simplified structure of the device, with each of the cartridges being separately exchangeable. In view of the foregoing, it is an object of the present invention to provide an image forming device which achieves size reduction with simplified structure while the image forming device includes the photosensitive member cartridge, the developing cartridge, and the toner cartridge can be exchanged separately depending on lifetime thereof.

In addition, in the device disclosed in the Publication, after the photosensitive member cartridge, the developing cartridge, and the toner cartridge are integrated together and taken out at once, a cartridge to be exchanged is separated and exchanged with a new cartridge. For this reason, even in a case where only the toner cartridge is to be exchanged, each of the cartridges needs to be removed from the device once. Therefore, workability of exchanging cartridges is not sufficient. In addition, there is room for improvement for a guide for guiding each of the cartridges being mounted or removed. Therefore, the present invention is invented to provide the toner cartridge, the developing cartridge, or the photosensitive member cartridge which can easily be exchanged by separating the cartridges individually as described above.

In order to attain the above and other objects, the invention provides an image forming device includes an image forming device. The image forming device includes a main body, an image bearing unit, a toner unit, and a developer unit. The main body has a loading port. The image bearing unit has a photosensitive drum configured to have an electrostatic latent image formed thereon. The image bearing unit is configured to be detachably attached to the main body thorough the loading port. The toner unit is configured to accommodate toner therein and has an agitator configured to agitate the toner. The toner unit is configured to be detachably attached to the main body thorough the loading port. The developer unit has a developing roller configured to develop the electrostatic latent image formed on the photosensitive drum by the toner. The developer unit is configured to be detachably attached to the main body thorough the loading port. The toner unit, the developer unit, and the image bearing unit are located in this order from the loading port to an inside of the main body, when the toner unit, the developer unit, and the image bearing unit are attached in the main body. The toner unit is configured to be independently detached from the main body, when the image bearing unit and the developer unit are attached to the main body.

According to another aspect, the present invention provides an image forming device. The image forming device includes a main body, an image bearing unit, a toner unit, and a developer unit. The main body has a loading port. The image bearing unit has a photosensitive drum configured to have an electrostatic latent image formed thereon. The image bearing unit is configured to be detachably attached to the main body thorough the loading port. The toner unit is configured to accommodate toner therein and having an agitator configured to agitate the toner. The toner unit is configured to be detachably attached to the main body thorough the loading port. The developer unit has a developing roller configured to develop the electrostatic latent image formed on the photosensitive drum by the toner. The developer unit is configured to be detachably attached to the main body thorough the loading port. The toner unit, the developer unit, and the image bearing unit are located in this order from the loading port to an inside of the main body, when the toner unit, the developer unit, and the image bearing unit are attached in the main body. The main body has a first driving portion, a second driving portion, and a third driving portion. The image bearing unit has a first driven portion configured to transmit a driving force from the first driving portion to the photosensitive drum. The developer unit has a second driven portion configured to transmit a driving force from the second driving portion to the developing roller. The toner unit has a third driven portion configured to transmit a driving force from the third driving portion to the agitator.

DETAILED DESCRIPTION

Figure 1:
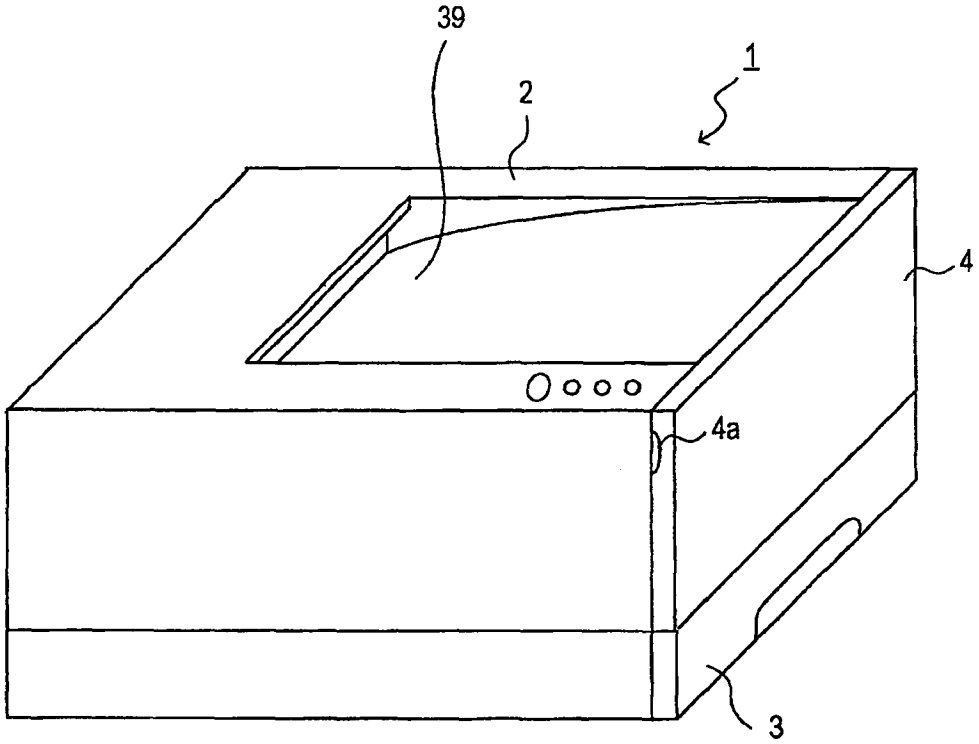
FIG. 1 is a perspective view showing an external view of a laser printer to which the present invention is applied.

Next, an embodiment of the present invention will be described with reference to the accompanying drawings. FIG. 1 is a perspective view showing an external view of a laser printer 1 as an image forming device to which the present invention is applied. As shown in FIG. 1, a cover 2 covers a body of the laser printer 1 from an outer periphery. A paper feeding cassette 3 is mounted to a lower part of the cover 2. A lid portion 4 of the cover 2 is provided on a front surface of the cover 2 (that is, a surface which is arranged in the front when the laser printer 1 is installed).

Figure 2:
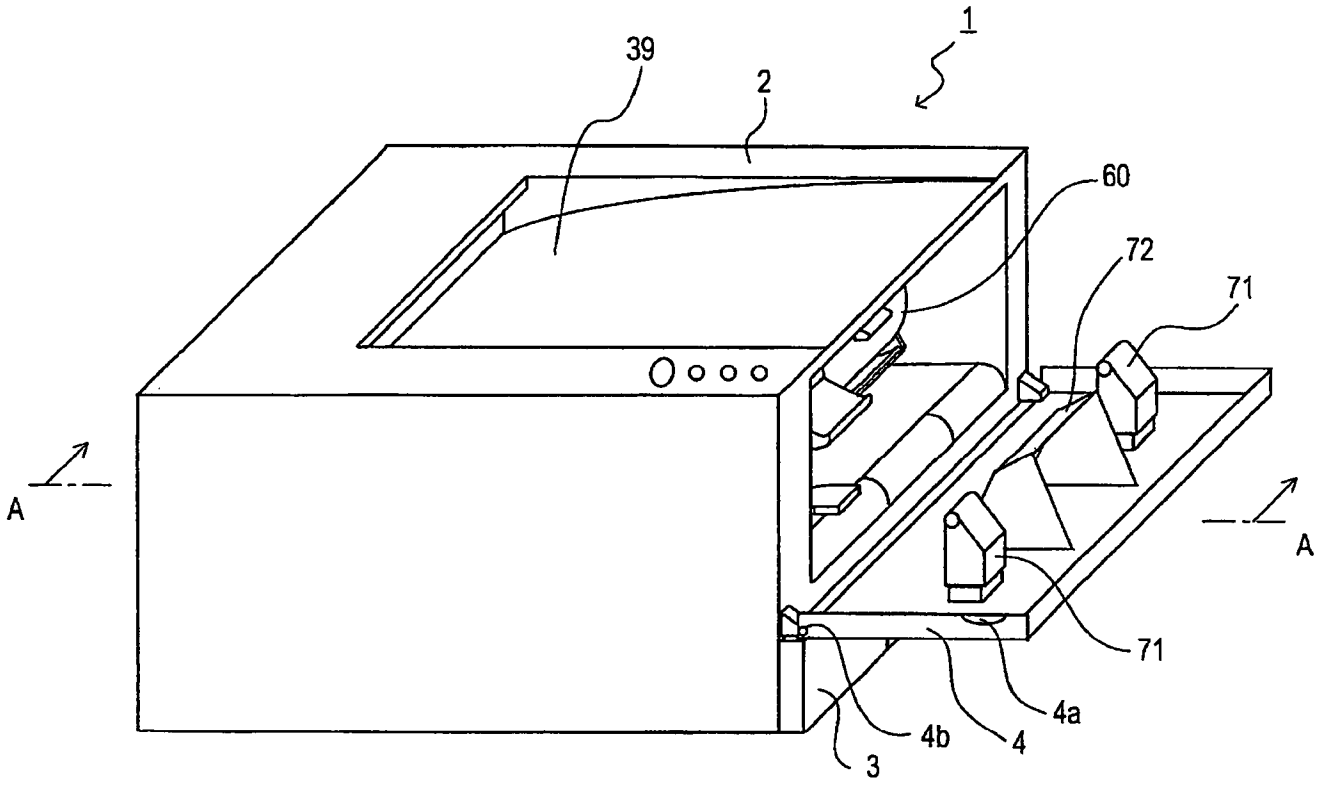
FIG. 2 is a perspective view showing operation of opening a lid portion of the laser printer.
Figure 3:
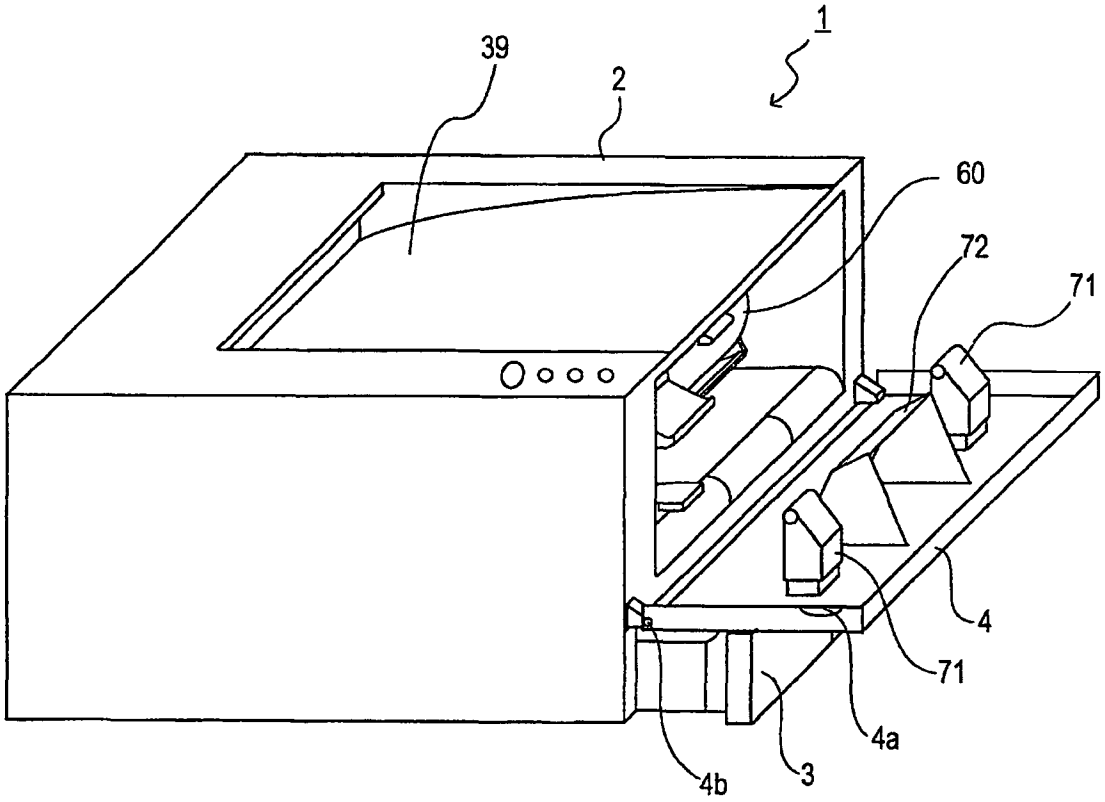
FIG. 3 is a perspective view showing operation of pulling out a paper feeding cassette of the laser printer.

As shown in FIG. 2, the lid portion 4 includes a finger hook part 4*a* on an upper side of both left and right edges. The lid portion 4 can be open in a front direction around a hinge 4*b* on a bottom edge by pulling the finger hook part 4*a*. Further, as shown in FIG. 3, the paper feeding cassette 3 is capable of pulling out in a front direction. By being pulled out in this way, the paper feeding cassette 3 can removed from the laser printer 1.

Figure 4:
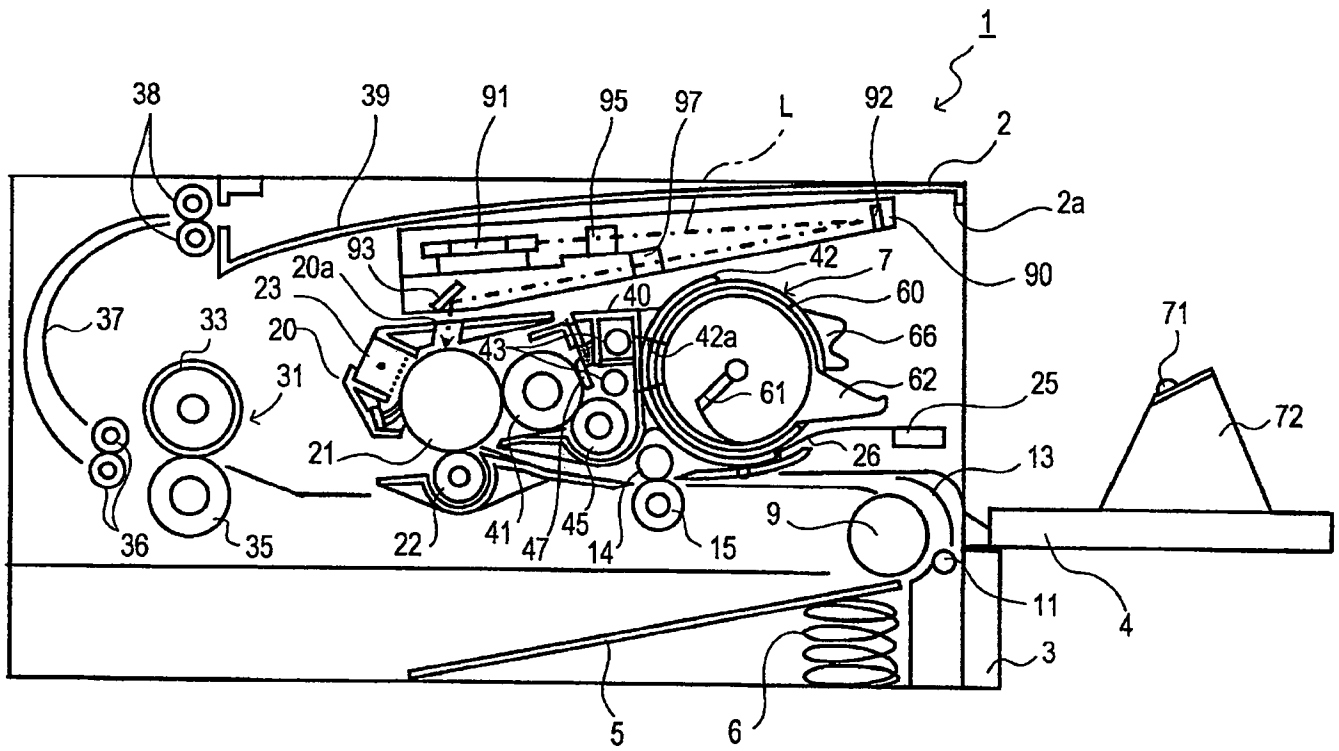
FIG. 4 is a vertical cross sectional diagram showing an inside configuration of the laser printer.

Next, FIG. 4 is a vertical cross sectional diagram showing an internal configuration of the laser printer 1. FIG. 4 is a cross section cut along the A-A line in FIG. 2. As shown in FIG. 4, a supporting plate 5 is provided in the paper feeding cassette 3. The supporting plate 5 is urged upward by a spring 6. A paper feeding roller 9 is provided on a front and upper side of the supporting plate 5. The paper feeding roller 9 separates sheets of paper (not shown) retained on the supporting plate 5 in a laminated manner sheet by sheet, and supplies the separated sheet of paper in a direction of an image forming unit 7. The laser printer 1 includes the paper feeding roller 9, a conveying roller 11, a guide 13, and a pair of registration rollers 14 and 15, in this order, in a conveying path of the paper to a image forming unit 7. The conveying roller 11 conveys the paper in cooperation with the paper feeding roller 9. The guide 13 turns the paper conveyed by the conveying roller 11 for about 180° along an outer periphery of the paper feeding roller 9. The pair of the registration rollers 14 and 15 lock a front edge of the paper by stopping as appropriate to correct oblique conveyance of the paper.

The image forming unit 7 includes a photosensitive drum 21 and a transfer roller 22. The photosensitive drum 21 works as a photosensitive member provided in a photosensitive member cartridge 20. The transfer roller 22 faces the photosensitive drum 21. The paper passes between the photosensitive drum 21 and the transfer roller 22 to have an image formed thereon by toner as will be described later, and is supplied to a fixing unit 31. In the fixing unit 31, the toner image formed on the paper is heat fixed by being sandwiched by a heating roller 33 and a pressing roller 35. The paper on which the image is fixed is further conveyed by a pair of conveying rollers 36 and 36.

The paper conveyed by the conveying rollers 36 and 36 is led to an upper direction of the cover 2 by a guide 37. The paper is then discharged to a paper discharge tray 39 provided on an upper surface of the cover 2 by a pair of paper discharge rollers 38 and 38. In addition, a scanner unit 90 is disposed between the paper discharge tray 39 and the photosensitive member cartridge 20. The scanner unit 90 exposes the photosensitive drum 21 with laser light L.

Configurations of the image forming unit 7 and the scanner unit 90 will be described more in detail. The photosensitive member cartridge 20 includes the photosensitive drum 21 having a photosensitive layer on a front surface in a rotatable manner. Further, the photosensitive member cartridge 20 includes a Scorotron charger 23 which uniformly charges front surfaces of the transfer roller 22 and the photosensitive drum 21. On the front surface of the photosensitive drum 21 charged by the Scorotron charger 23, an electrostatic latent image is formed by the laser light L which enters from the scanner unit 90 through an exposure opening 20*a*. Subsequently, a developing roller 41 supplies the toner to the front surface of the photosensitive drum 21 to develop the electrostatic latent image. The developing roller 41 works as a developing unit provided in a developing cartridge 40 which will be described in the next paragraph. The toner adhered to the photosensitive drum 21 in the manner described above is transferred to the paper passing between the photosensitive drum 21 and the transfer roller 22. Accordingly, the image is formed on the paper.

As shown in FIG. 4, the developing roller 41 is rotatably supported by the developing cartridge 40. The developing roller 41 contacts the photosensitive drum 21 and is rotatably driven by a mechanism which will be described later. The developing cartridge 40 includes a supporting unit 42 which supports a toner cartridge 60 in a removable manner. An opening 42*a* is pierced through the supporting unit 42 (see FIG. 7). The toner is supplied through the opening 42*a* from the toner cartridge 60. Further, the developing cartridge 40 includes a pair of augers 43 and 43, a supplying roller 45, and a developing blade 47. The pair of the augers 43 and 43 conveys the toner from the opening 42*a* disposed on a center in an axial direction of the supplying roller 45 to both sides of the supplying roller 45 in the axial direction. The supplying roller 45 supplies the toner conveyed by the augers 43 and 43 toward the developing roller 41. The developing blade 47 frictionally charges the toner adhered to a front surface of the developing roller 41 by the supplying roller 45 and forms a thin layer of the toner. An agitator 61 is provided inside the toner cartridge 60 in a rotatable manner. The agitator 61 agitates the toner contained in the toner cartridge 60 and supplies the toner to a side of the developing cartridge 40.

Subsequently, a configuration of the scanner unit 90 will be described. The scanner unit 90 includes a polygon mirror 91 and mirrors 92 and 93. The polygon mirror 91 deflects and scans the laser light L generated by a laser generating unit (not shown). Mirrors 92 and 93 reflect the laser light L deflected by the polygon mirror 91 toward the photosensitive drum 21. In addition, an fθ lens 95 is fixed in a light path of the laser light L from the polygon mirror 91 to the mirror 92, and a cylindrical lens 97 is fixed in a light path of the laser light L from the mirror 92 to the mirror 93.

In the above configuration, the polygon mirror 91 and the photosensitive drum 21 are rotated to exit the laser light L in an appropriate timing. Thereby, an electrostatic latent image can be formed on a front surface of the photosensitive drum 21. Then, as described above, the electrostatic latent image is transferred to the paper after being developed with the toner through the developing roller 41. Thereby, images can be formed by electrophotography processes.

Figure 5:
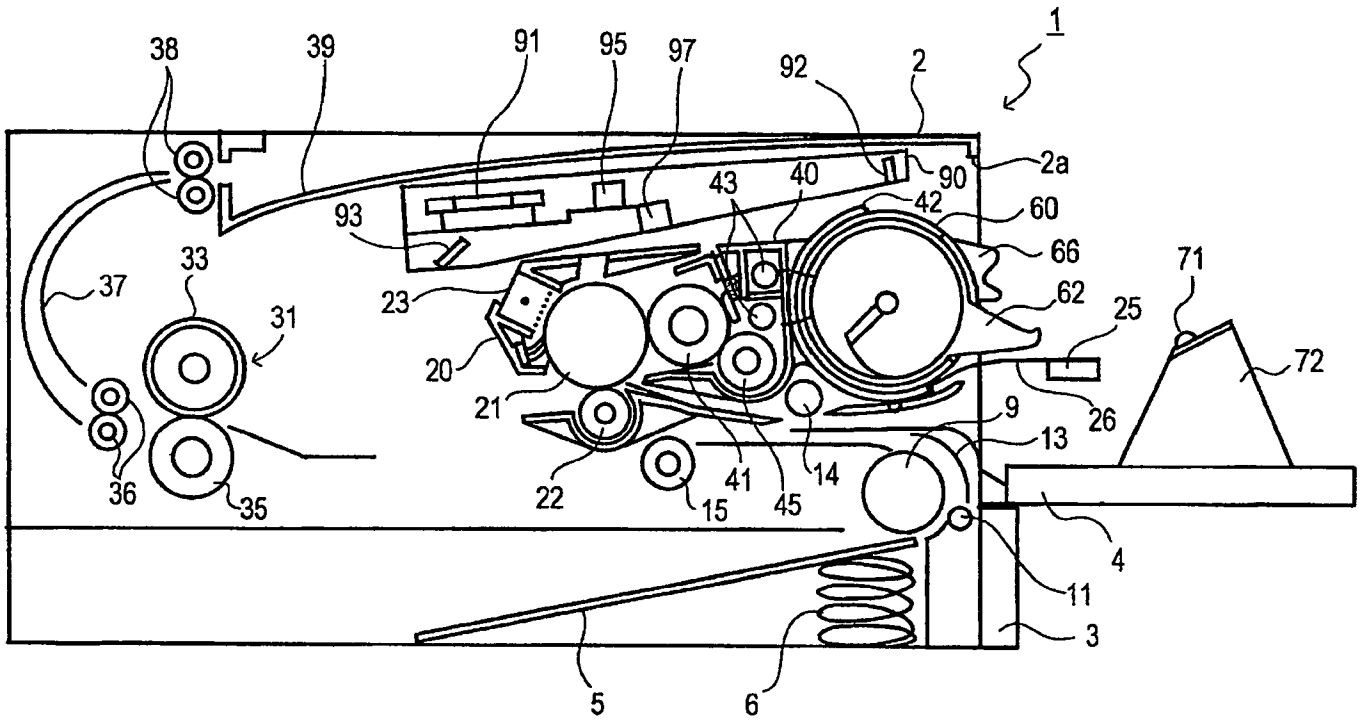
FIG. 5 is a vertical cross sectional diagram showing an operation of removing the cartridges of the printer in an integrated manner.

Next, as shown in FIG. 5, the lid portion 4 is opened, and further, a handle 25 of the photosensitive member cartridge 20 is pulled in a front direction. In this manner, the photosensitive member cartridge 20 can be taken out with the developing cartridge 40 and the toner cartridge 60 in an integrated manner from a mounting/removing opening 2*a* to outside a device body of the laser printer 1. The mounting/removing opening 2 is an opening of the cover 2 closed by the lid portion 4.

Figure 6:
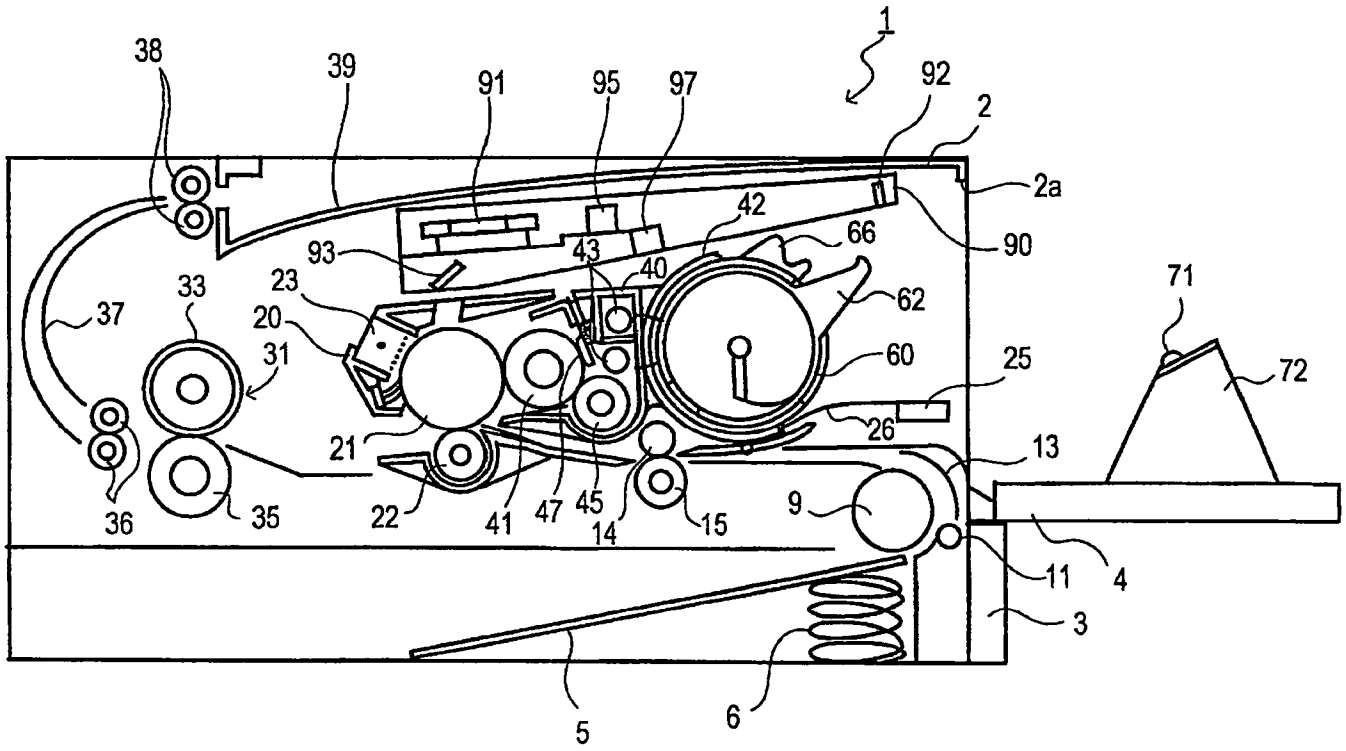
FIG. 6 is a vertical cross sectional diagram showing an operation of separating a toner cartridge and a developing cartridge of the laser printer.
Figure 7:
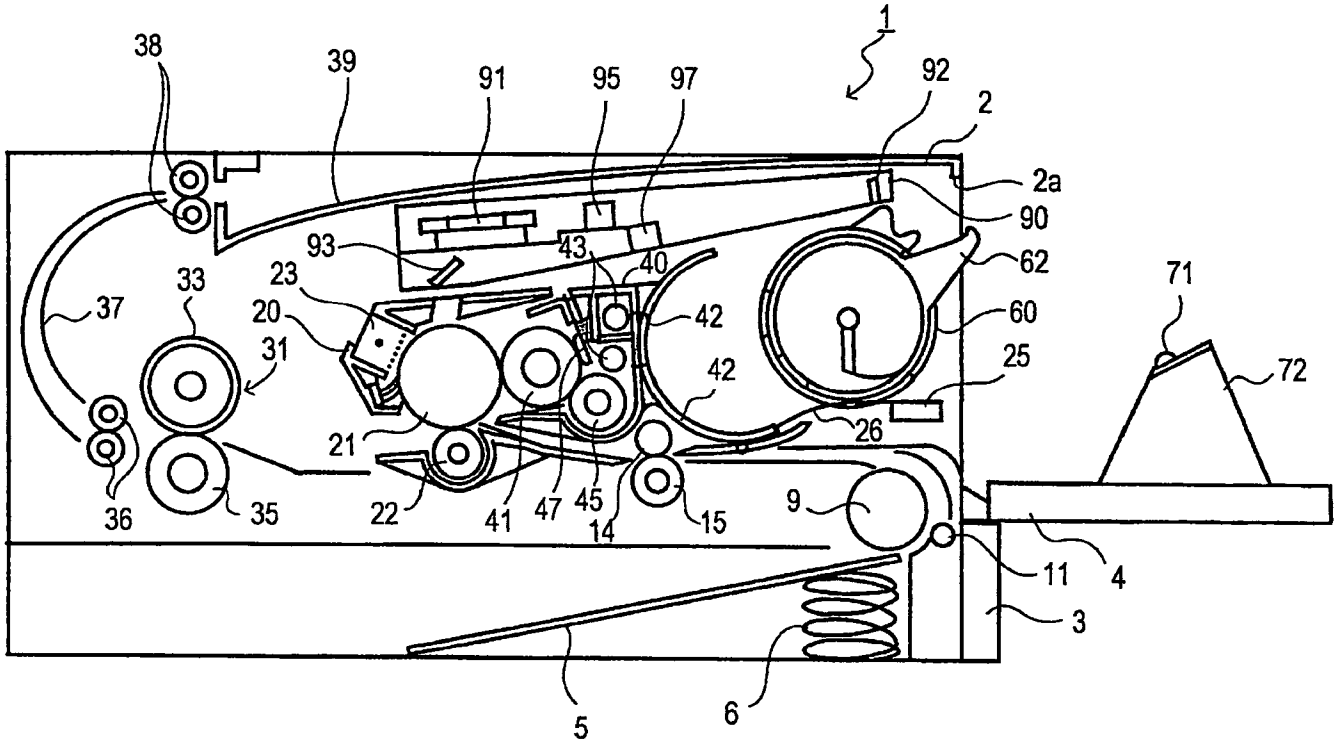
FIG. 7 is a vertical cross sectional diagram showing an operation of removing only the toner cartridge of the laser printer.

In addition, as shown in FIG. 6, when a handle 62 of the toner cartridge 60 is rotated to an upward direction, the toner cartridge 60 is separated from the developing cartridge 40 as described later. Subsequently, as shown in FIG. 7, when the handle 62 is pulled in a front direction, only the toner cartridge 60 can be removed from the mounting/removing opening 2*a* to outside the device body of the laser printer 1. That is, the mounting/removing opening 2*a* corresponds to a toner cartridge mounting/removing opening.

Figure 8:
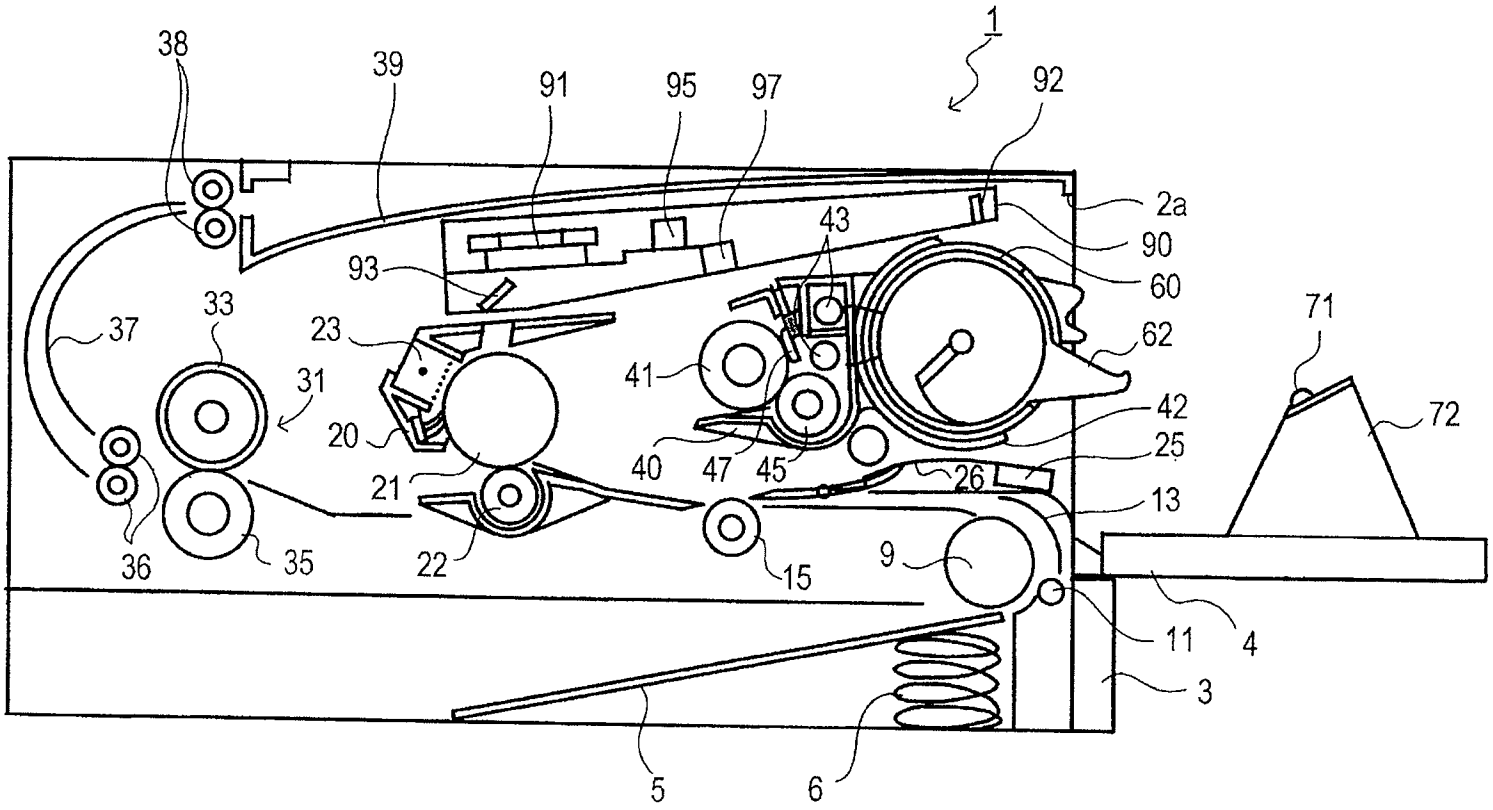
FIG. 8 is a vertical cross sectional diagram showing an operation of removing the developing cartridge and the toner cartridge of the laser printer in an integrated manner.

Moreover, as shown in FIG. 8, when the handle 25 of the photosensitive member cartridge 20 is pressed down, the developing cartridge 40 is separated from the photosensitive member cartridge 20 as described later. Further, when the handle 62 of the toner cartridge 60 is pulled in a front direction without rotating to the upward direction, the toner cartridge 60 and the developing cartridge 40 can be removed from the mounting/removing opening 2*a* to outside the device body of the laser printer 1.

A configuration of switching over a connection and a separation between each of the cartridges 20, 40, and 60 will be described. First, a configuration of switching over a connection and a separation between the developing cartridge 40 and the toner cartridge 60 will be described.

Figure 9A:
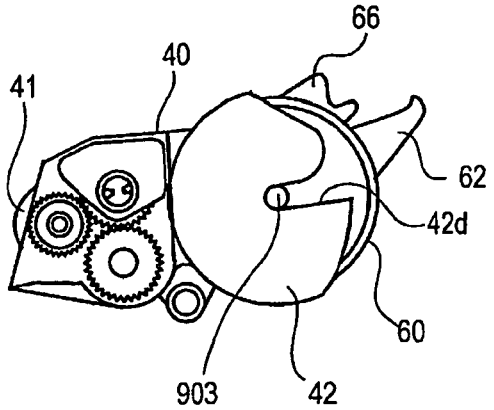
FIG. 9A is an explanatory diagram showing a separated state explaining a mechanism of switching over a connection and a separation between the developing cartridge and the toner cartridge.
Figure 9B:
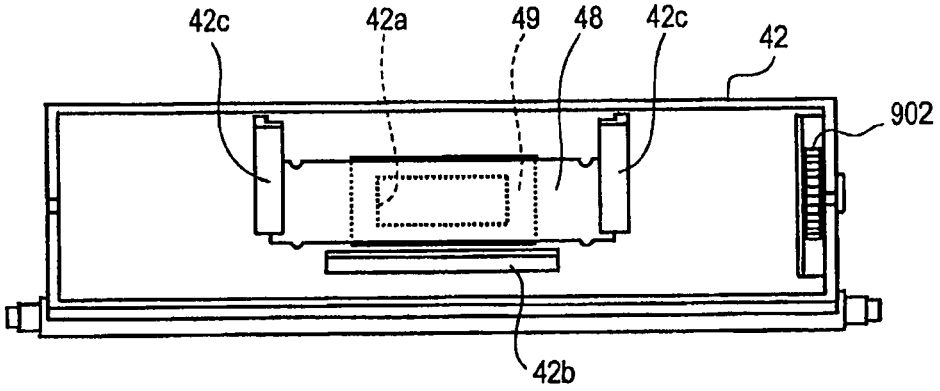
FIG. 9B is a view of a supporting member of the developing cartridge from a side of the toner cartridge.
Figure 9C:
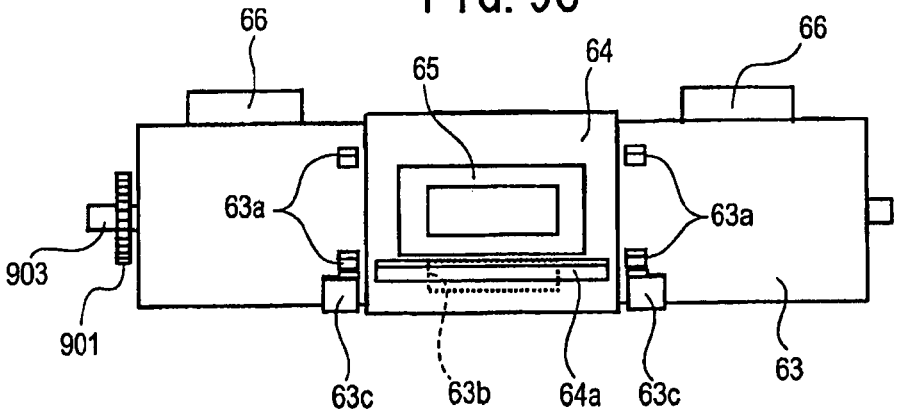
FIG. 9C is a view showing the toner cartridge from a side of the supporting member.

FIG. 9B and FIG. 9C show a state in which the handle 62 of the toner cartridge 60 is rotated to an upward direction (hereinafter, referred to as the separating position) as shown in FIG. 9A. FIG. 9B is a view of the supporting unit 42 of the developing cartridge 40 when viewed from a side of the toner cartridge 60. FIG. 9C is a view of the toner cartridge 60 viewed from a side of the supporting unit 42.

As shown in FIG. 9C, the toner cartridge 60 includes an inner cylinder 63 and an outer cylinder 64. The inner cylinder 63 has an elongated cylindrical shape and contains the toner inside. The outer cylinder 64 is fitted over a central part of the inner cylinder 63. A convex 64*a* protrudes to a side of the supporting unit 42 when the outer cylinder 64 is mounted in the supporting unit 42. The outer cylinder 64 is mounted in the supporting unit 42 by engaging a convex 64*a* with a long groove 42*b* on an inner wall surface of the supporting unit 42. Thus, the outer cylinder 64 is prevented from rotating to the supporting unit 42 by the engagement between the supporting unit 42 and the convex 64*a*. The inner cylinder 63 is integrally formed with the handle 62 and rotatably disposed on a inner side of the outer cylinder 64 corresponding to operation of the handle 62.

In addition, as shown in FIG. 9B, a shutter 48 made of a metal plate is provided inside the supporting unit 42. Both edges of the shutter 48 are supported by a rail 42*c* formed on an inner wall surface of the supporting unit 42. Thereby, the shutter 48 is arranged between a position at which the shutter 48 blocks the opening 42*a* of the supporting unit 42 as shown in FIG. 9B and a position above the opening 42*a* (see FIG. 10B), in a movable manner in a direction of the inner periphery of the supporting unit 42.

Four protrusions 63*a* are formed on a front surface of the inner cylinder 63. Four protrusions 63*a* serve to hold the shutter 48 of four corners thereof, two corners being circumferentially disposed from the remaining two corners. For this reason, the shutter 48 moves corresponding to a rotation of the inner cylinder 63. When the handle 62 is located at the separating position, the shutter 48 is located at the position at which the shutter 48 blocks the opening 42*a* as shown in FIGS. 9B and 9C. The long groove 42*b* described above is formed in a lower position than the shutter 48 so that the long groove 42*b* does not overlap the shutter 48 that is located in the position at which the shutter 48 blocks the opening 42*a*. In addition, the opening 42*a* is configured to have a rectangular shape with a longer side being in a horizontal direction. A sponge 49 having a rectangular frame shape surrounding the opening 42*a* is affixed on an inner wall surface of the supporting unit 42 around the opening 42*a*.

An opening 64*b* having the same shape as the opening 42*a* is formed in a position facing the opening 42*a* when the convex 64*a* is engaged with the long groove 42*b*. A sponge 65 having the same shape as the sponge 49 is affixed around the opening 64*b*. In addition, an opening 63*b* having the same shape as the opening 64*b* is formed in the inner cylinder 63 as well. The opening 64*b* and the opening 63*b* do not overlap each other at all when the handle 62 is located at the separating position as shown in FIG. 9C. For this reason, even when the toner cartridge 60 is taken out, the inside toner does not spill over.

Figure 10A:
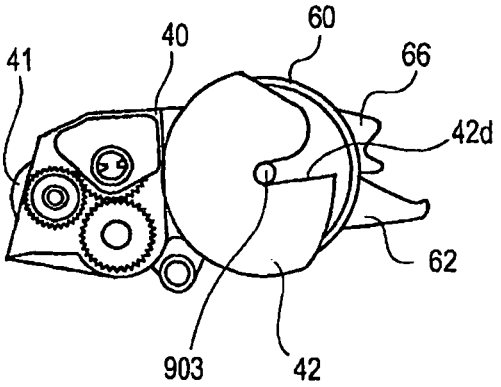
FIG. 10A is an explanatory diagram showing a connected state explaining a mechanism of switching over a connection and a separation between the developing cartridge and the toner cartridge.
Figure 10B:
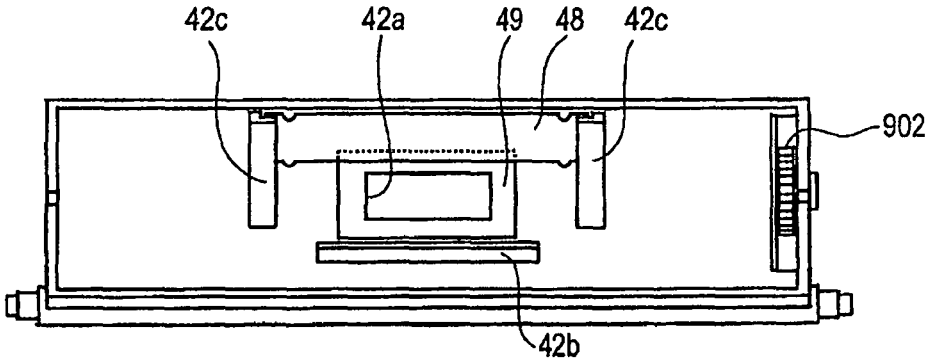
FIG. 10B is a view of a supporting member of the developing cartridge from a side of the toner cartridge.
Figure 10C:
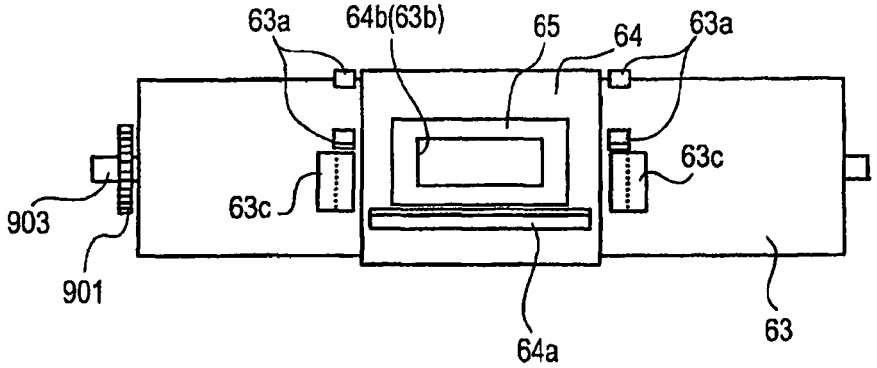
FIG. 10C is a view showing the toner cartridge from a side of the supporting member.

Then, when the handle 62 of the toner cartridge 60 is rotated to a downward direction as shown in FIG. 10A (hereinafter, the handle 62 located at this position is referred to as a connecting position) with the convex 64*a* engaged with the long groove 42*b*, the opening 64*b* and the opening 63*b* overlap each other as shown in FIG. 10C. In addition, at this time, as shown in FIG. 10B, the shutter 48 is moved to an upper direction of the opening 42*a* by the protrusion 63*a*. In this manner, the opening 64*ba* is communicated with the opening 42*a*, and the toner can be supplied to the developing cartridge 40 from the toner cartridge 60.

Further, at this time, the sponge 49 are in close contact with the sponge 65. An engaging portion 63*c* is integrally formed on an outer periphery surface of the inner cylinder 63 and is engaged with the rail 42*c*. Therefore, peripheries of the openings 64*b* and 42*a* are sealed and the toner never spills over to the outside. In addition, by the engagement of the engaging portion 63*c* and the rail 42*c*, the developing cartridge 40 is connected to the toner cartridge 60. Thereby, the developing cartridge 40 and the toner cartridge 60 can be mounted and removed in an integrated manner as described above (see FIG. 8). On contrary, the handle 62 is operated to rotate the inner cylinder 63, and the engaging portion 63*c* and the rail 42*c* are disengaged one from the other. Thereby, the toner cartridge 60 can be separated from the developing cartridge 40. Thus, only the toner cartridge 60 can be removed as described above (see FIG. 7).

In addition, a gear 901 is provided on an external side of one end of the inner cylinder 63. The gear 901 rotates with the agitator 61 in an integrated manner. A gear 902 is exposed on the supporting unit 42 at a position facing the gear 901. The gear 902 transmits a driving force to the gear 901. For this reason, by mounting the toner cartridge 60 in the supporting unit 42 and engaging the engaging portion 63*c* with the rail 42*c* as described above, the agitator 61 can be driven via the gears 902 and 901.

Further, a rotational shaft 903 of the gear 901 protrudes to the left and right as shown in FIG. 10C. A guide grooves 42*d* are formed on surfaces of left and right edges of the supporting unit 42. The guide grooves 42*d* guide the rotational shaft 903. When the toner cartridge 60 is mounted, the rotational shaft 903 can be guided by the guide grooves 42*d*. Therefore, the convex 64*a* can easily be engaged with the long groove 42*b*.

Figure 11A:
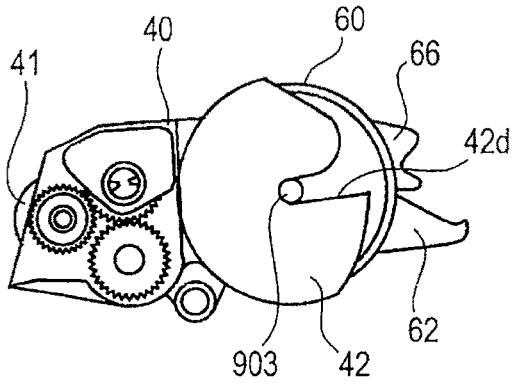
FIG. 11A is a right side view showing configurations of the developing cartridge and the toner cartridge.
Figure 11B:
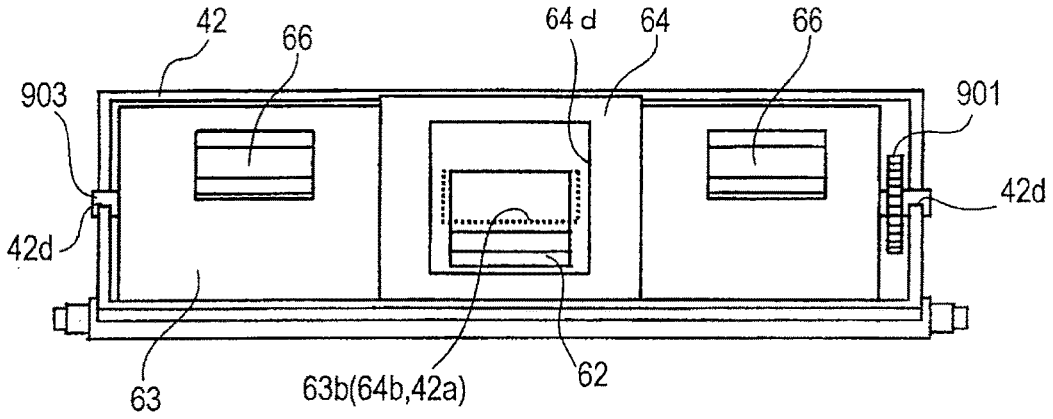
FIG. 11B is a front view showing configurations of the developing cartridge and the toner cartridge.
Figure 11C:
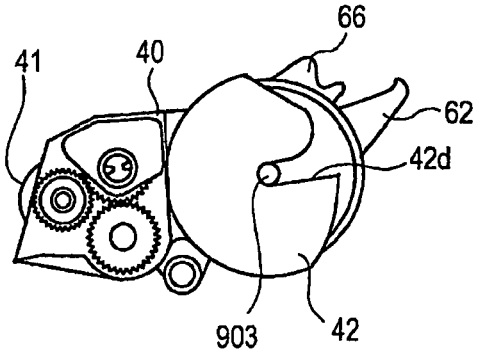
FIG. 11C is a right side view showing configurations of the developing cartridge and the toner cartridge.
Figure 11D:
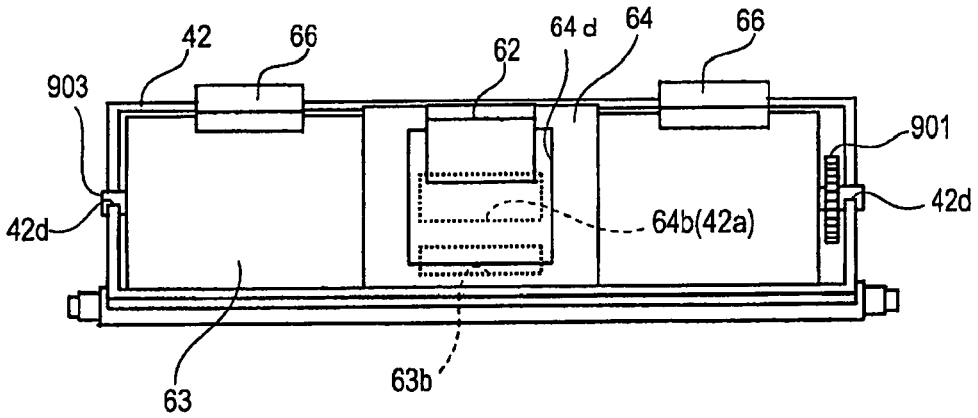
FIG. 11D is a front view showing configurations of the developing cartridge and the toner cartridge.

Next, FIG. 11B is a view of the developing cartridge 40 and the toner cartridge 60 viewed from a front surface side when the handle 62 is located at the connecting position as shown in FIG. 11A. FIG. 11D is a view of the developing cartridge 40 and the toner cartridge 60 viewed from a front surface side when the handle 62 is located at the separating position as shown in FIG. 11C.

As shown in FIGS. 11B and 11D, an opening 64*d* is formed on a front surface side of the outer cylinder 64. The opening 64*d* penetrates the outer cylinder 64 such that the handle 62 is rotatable. In addition, a pair of spring receiving part 66 and 66 are formed both the left and right of a front surface of the inner cylinder 63 at little upper positions than both sides of the handle 62. The pair of spring receiving units 66 and 66 have a depressed center part in a circumferential direction. As shown in FIG. 2, a pair of pressing members 71 and 71 is disposed on an inner surface of the lid portion 4. The pair of pressing members 71 and 71 is urged by springs (not shown) in a protruding direction of the pressing member 71. The spring receiving units 66 and 66 receive a pressing force from the pressing members 71 and 71 when the lid portion 4 is closed. Thus, each of the cartridges 20, 40, and 60 are securely fixed inside the laser printer 1 by the pressing force. In addition, an interfering member 72 protrudes between a position of the pressing members 71 and 71. If the handle 62 is not located in the connecting position, the lid portion 4 is configured so as to be unable to close due to interferences between the handle 62 and the interring member 72.

Figure 12A:
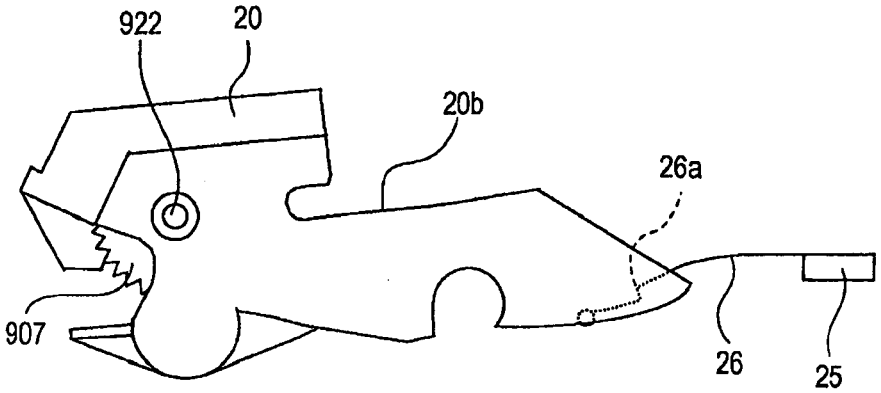
FIG. 12A is a right side view showing a configuration of a photosensitive member cartridge.
Figure 12B:
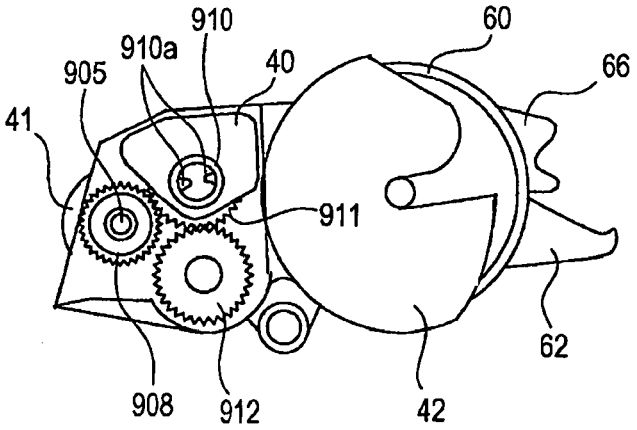
FIG. 12B is a right side view showing configurations of the developing cartridge and the photosensitive member cartridge.
Figure 12C:
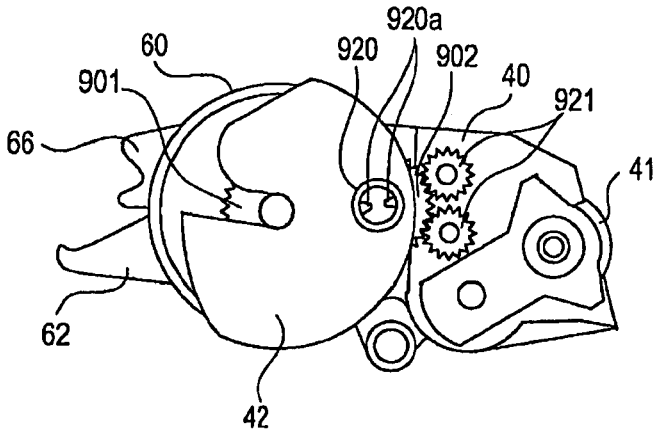
FIG. 12C is a left side view showing configurations of the developing cartridge and the photosensitive member cartridge.
Figure 12D:
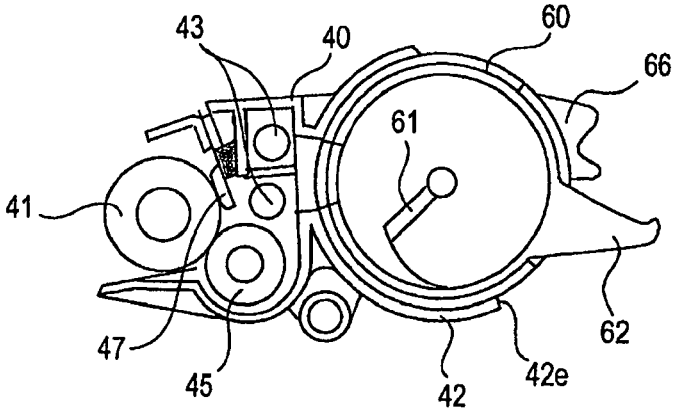
FIG. 12D is a vertical cross sectional diagram showing configurations of the developing cartridge and the photosensitive member cartridge.

Next, FIG. 12A is a right side view showing a configuration of the photosensitive member cartridge 20, FIG. 12B is a right side view showing configurations of the developing cartridge 40 and the toner cartridge 60, FIG. 12C is a left side view showing configurations of the developing cartridge 40 and the toner cartridge 60, and FIG. 12D is a vertical cross sectional diagram showing configurations of the developing cartridge 40 and the toner cartridge 60.

As shown in FIG. 12A, the handle 25 of the photosensitive member cartridge 20 is fixed to the photosensitive member cartridge 20 with a plate spring 26 therebetween. The plate spring 26 has a bending section 26*a* in the middle of the plate spring. The plate spring 26 is upwardly bent in a stepwise shape at the bending section 26. When the developing cartridge 40 is mounted in the photosensitive member cartridge 20, the bending section 26*a* engages with a lower side 42*e* (see FIG. 12D) of the supporting unit 42 to connect the developing cartridge 40 to the photosensitive member cartridge 20. For this reason, when the handle 25 is pressed down (see FIG. 8) as described above, the bending section 26*a* and the lower side 42*e* are disengaged one from the other. Thereby, the developing cartridge 40 can be mounted in and removed from the photosensitive member cartridge 20.

In addition, a rotational shaft 905 of the developing roller 41 protrudes in both the left and right direction from the developing cartridge 40. Guide grooves 20*b* into which the rotational shaft 905 fits are formed on both the left and right surfaces of the photosensitive member cartridge 20. For this reason, the developing cartridge 40 is mounted in and removed from the photosensitive member cartridge 20 while both ends of the rotational shaft 905 are fitted into the guide groove 20*b*. Thereby, the mounting and removing of the developing cartridge 40 is facilitated.

A gear 907 is provided in the photosensitive member cartridge 20. The gear 907 rotates with the photosensitive drum 21 in an integrated manner. When the developing cartridge 40 and the photosensitive member cartridge 20 are mounted in the device body, the gear 907 engages with a gear 999 provided in the device body (see FIG. 13). In addition, a gear 908 is provided in the developing cartridge 40 and rotates with the developing roller 41 in an integrated manner. As shown in FIG. 12B, the gear 908 engages with a gear 911. A drive shaft 910 is provided on a right side surface of the developing cartridge 40. The gear 911 is rotates with the drive shaft 910 in an integrated manner. Further, the gear 911 also engages with a gear 912 which rotates with the supplying roller 45 in an integrated manner. For this reason, a driving force transmitted to the gear 999 is transmitted to the photosensitive drum 21, and a driving force transmitted to the drive shaft 910 is transmitted to the supplying roller 45 and the developing roller 41 as described later, respectively.

As shown in FIG. 12C, a drive shaft 920 is provided on a left side surface of the developing cartridge 40. The drive shaft 920 rotates with the gear 902 in an integrated manner. In addition, the gear 902 also engages with a pair of gears 921 and 921 which rotate with the pair of the augers 43 and 43 in an integrated manner. For this reason, when a driving force is transmitted to the drive shaft 920 of the developing cartridge 40 to which the toner cartridge 60 is connected, such driving force can further be transmitted to the agitator 61 and the pair of the augers 43 and 43.

Figure 13:
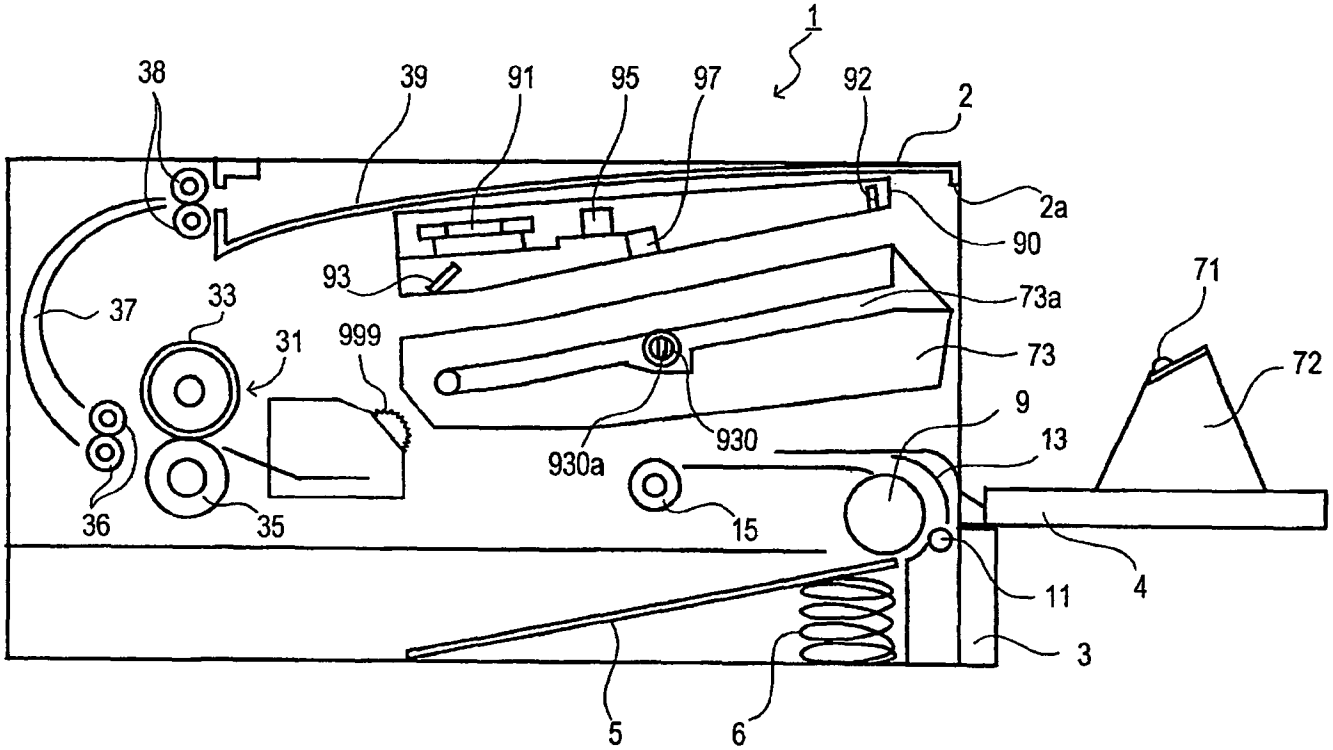
FIG. 13 is a vertical cross sectional diagram showing a state in which all the cartridges of the laser printer are removed.

FIG. 13 is a vertical cross sectional diagram showing a state in which all the cartridges 20, 40, and 60 of the laser printer 1 are removed. As shown in FIG. 13, guide members 73 and 73 for guiding the photosensitive member cartridge 20 and the developing cartridge 40 are provided on left and right inner wall surfaces of the cover 2 (only left side one is illustrated in FIG. 13). The guide members 73 and 73 are provided with guide grooves 73*a* and 73*a* having a substantially linear shape. The guide grooves 73*a* and 73*a* guide both ends of a rotational shaft 922 of the photosensitive drum 21 (see FIG. 12A) and the drive shaft 910 or 920 described above. The drive shafts 930 and 930 are disposed at positions on the guide grooves 73*a* and 73*a* where the guide grooves 73*a* and 73*a* face the drive shafts 910 and 920 when the developing cartridge 40 is mounted. The drive shafts 930 and 930 are rotatably provided. The drive shafts 930 and 930 transmit a driving force from a main motor (not shown) provided in the device body of the laser printer 1.

As shown in FIGS. 12B and 12C, both the drive shafts 910 and 920 have a hollow cylinder shape. A pair of protrusions 910*a* and 910*a* is provided at position facing each other at 180° on an inner surface wall the drive shaft 910. A pair of protrusions 920*a* and 920*a* is provided at position facing each other at 180° on the inner surface wall of the drive shaft 920. The drive shaft 930 is configured so as to be able to fit in a hollow part of the drive shafts 910 and 920. Further, grooves 930*a* are formed on the drive shafts 930. The grooves are engaged with the protrusion 910*a* and 920*a*. For this reason, by protruding the drive shafts 930 and 930 and engaging the drive shafts 930 and 930 with the drive shafts 910 and 920 after all the cartridges 20, 40, and 60 are mounted, each unit can drive as described above.

In the laser printer 1 according to the present embodiment as described above, the following can be carried out depending on what is required: removing and exchanging the photosensitive member cartridge 20, the developing cartridge 40, and the toner cartridge 60 in an integrated manner (see FIG. 5); removing and exchanging only the developing cartridge 40 and the toner cartridge 60 in an integrated manner (see FIG. 8); and removing and exchanging only the toner cartridge 60 (see FIG. 7). For this reason, exchanging work of each of the cartridges 20, 40, and 60 can be efficiently carried out. Further, since only the cartridges which need to be exchanged can be exchanged, the laser printer 1 according to the present embodiment provides excellent cost effectiveness.

When printing is carried out in the proportion of 5% with respect to an entire area of A4-size paper, life of the photosensitive member cartridge 20 is for 50000 sheets of paper, while life of the developing cartridge 40 is for 20000 sheets of paper and life of the toner cartridge 60 is for 3000 sheets of paper. The lives of each of the cartridges are based on following matters. That is, in the photosensitive member cartridge 20, the toner adhered to the developing roller 41 grinds a photosensitive layer of the photosensitive drum 21 like an abrading agent. Further, charging characteristics is degraded with age. For the above reasons, the photosensitive drum 21 can no longer stand the use after printing for around 50000 sheets of the A4-size paper. As for the developing cartridge 40, the developing roller 41 can no longer exert the performance after printing for around 20000 sheets of the A4-size paper due to friction with the supplying roller 45 and the developing blade 47. The toner cartridge 60 contains the toner for an amount enough for printing around 3000 sheets of A4-size paper.

As described above, the life of each of the cartridges 20, 40, and 60 is different from the other cartridges. For this reason, the cartridges are arranged, from the mounting/removing opening 2*a* side, in the order of shorter life, i.e. in the order of the toner cartridge 60, the developing cartridge 40, and the photosensitive member cartridge 20, which is the order of higher frequency of exchange. In this manner, as described above, only a part of the cartridges in the front can be exchanged, while the other cartridges deeper inside than the part of the cartridges is mounted in the device body. Therefore, workability of the exchange is further improved. When resolving paper jam, it is convenient to remove the photosensitive member cartridge 20, the developing cartridge 40, and the toner cartridge 60 in an integrated manner.

Further, each of the cartridges 20, 40, and 60 can be mounted and removed through the common mounting/removing opening 2*a* after passing through a common mounting and removing path. Therefore, the device does not become larger, and the mounting/removing opening 2*a* can be made comparatively small. Accordingly, a simplified configuration of the device is achieved. Therefore, in the laser printer 1 according to the present embodiment, a degree of freedom as to where to install the device is improved, and a manufacturing cost can be reduced. Further, the mounting/removing opening 2*a* is provided on a front surface side, and the front surface side is a side where the paper feeding cassette 3 is mounted in or removed from the device. Therefore, the mounting and removing of each of the cartridges 20, 40, and 60 is further facilitated.

The mounting and removing path of each of the cartridges 20, 40, and 60 may be curved. However, in the laser printer 1, each of the cartridges 20, 40, and 60 is mounted or removed along the guide groove 73*a* having a substantial linear shape. Therefore, the mounting and removing of each of the cartridges 20, 40, and 60 is further facilitated.

In addition, since the interfering member 72 is provided in the laser printer 1, the lid portion 4 cannot be closed if the handle 62 of the toner cartridge 60 is not located at the connecting position. In this manner, wrong operation such as instructing driving while the developing cartridge 40 and the toner cartridge 60 are separated can be prevented. The handle 62 may be interfere with, instead of the interfering member 72, a path of some member which works in association with the lid portion 4 such that the some member prevent the lid portion 4 from being closed. In this case as well, a similar effect can be obtained.

Figure 14:
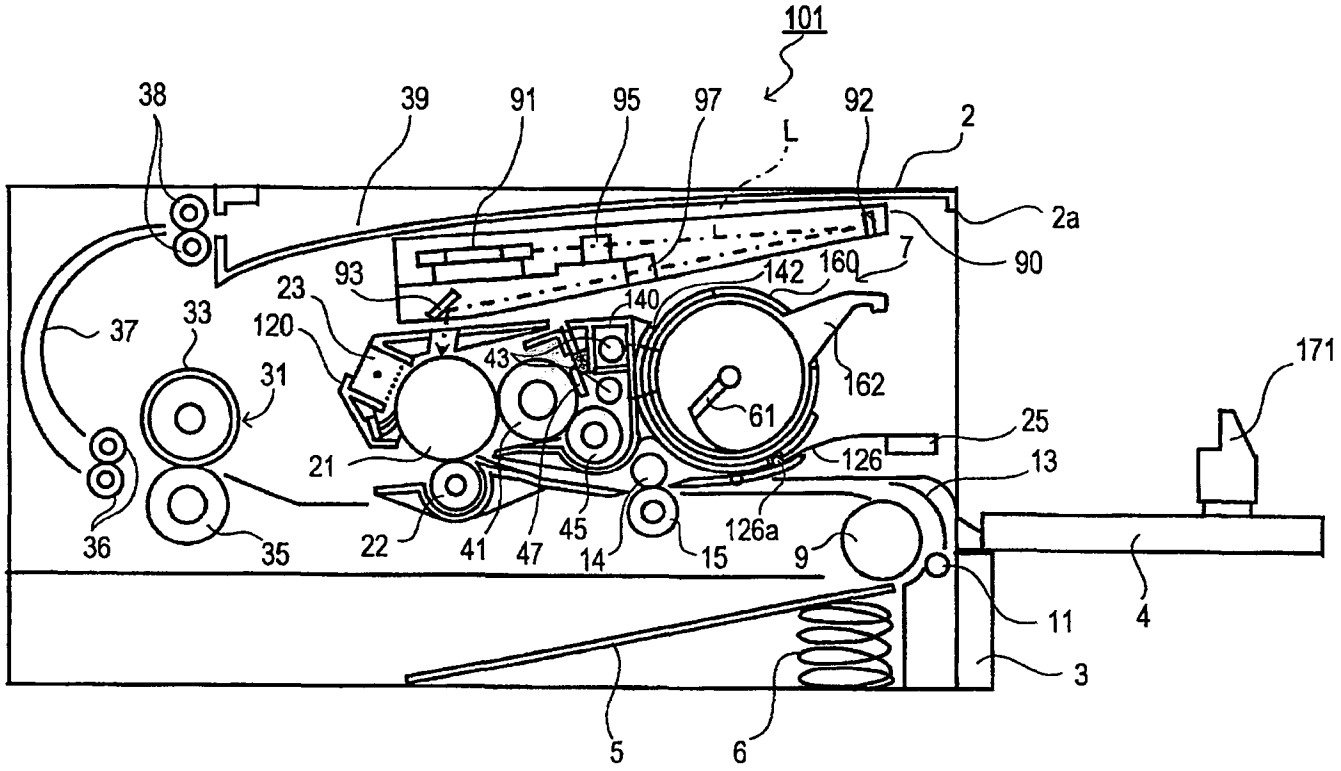
FIG. 14 is a vertical cross sectional diagram showing a configuration of a laser printer according to a second embodiment.

Next, FIG. 14 is a vertical cross sectional diagram showing a configuration of a laser printer 101 according to a second embodiment of the present invention. In each of the embodiments, a part similar to the laser printer 1 according to the first embodiment is indicated by the same reference numeral as used in FIGS. 1 to 13, and detailed description thereof is omitted.

The laser printer 101 according to the present embodiment is different from the laser printer 1 in a point that a supporting unit 142 provided in a developing cartridge 140. The supporting unit 142 has an opening toward a substantial upper direction and supports the toner cartridge 160. In accordance therewith, a hole 142*e* (see FIG. 16) is provided in the supporting unit 142 in place of the lower side 42*e*. A plate spring 126 which connects the handle 25 to a photosensitive member cartridge 120 is provided with a protrusion 126*a* fitting in the hole 142*e* in place of the bending section 26*a*.

In addition, as shown in FIG. 14, a handle 162 of the toner cartridge 160 is provided on an upper portion of the toner cartridge 160 even when the handle 162 is located at a connecting position. The lid portion 4 is provided with a pressing member 171 which presses the handle 162. Further, the laser printer 101 is not provided with the spring receiving unit 66 or the interfering member 72.

Figure 15:
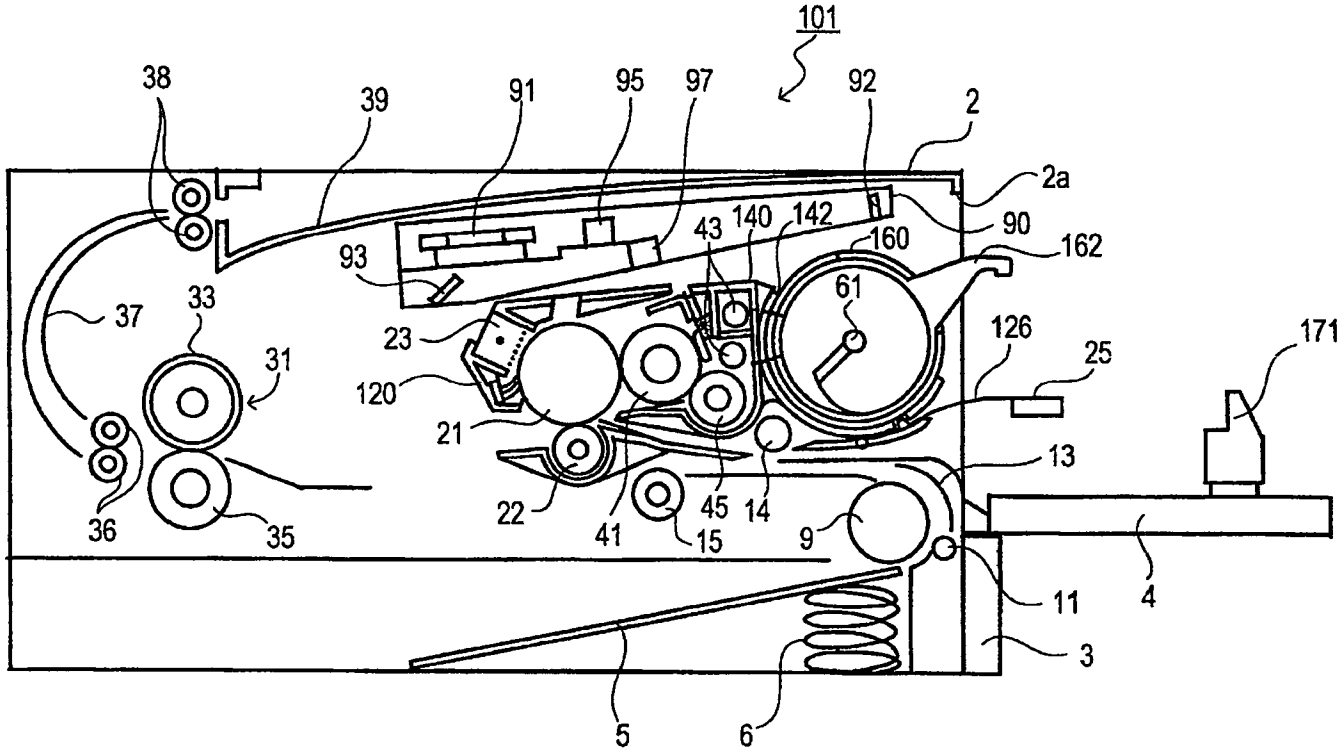
FIG. 15 is a vertical cross sectional diagram showing an operation of removing each of the cartridges of the laser printer in an integrated manner.

In the laser printer 101 as well, as shown in FIG. 15, after the lid portion 4 is opened and the handle 25 of the photosensitive member cartridge 120 is pulled in a front direction, the photosensitive member cartridge 120, the developing cartridge 140, and the toner cartridge 160 can be removed in an integrated manner from the mounting/removing opening 2*a* to outside the device body of the laser printer 101.

In addition, when the handle 25 of the photosensitive member cartridge 120 is pressed down, the developing cartridge 140 is separated from the photosensitive member cartridge 120. Subsequently, as shown in FIG. 16, when the handle 162 of the toner cartridge 160 is pulled in a front direction as-is, the toner cartridge 160 and the developing cartridge 140 can be taken out from the mounting/removing opening 2*a* to outside the device body.

However, in the laser printer 101, the supporting unit 140 has the opening in a substantial upper direction as described above. Therefore, the toner cartridge 160 cannot be mounted or removed while the developing cartridge 140 is left inside the device body. For this reason, the mounting and removing of the toner cartridge 160 is carried out as described below.

Figure 16:
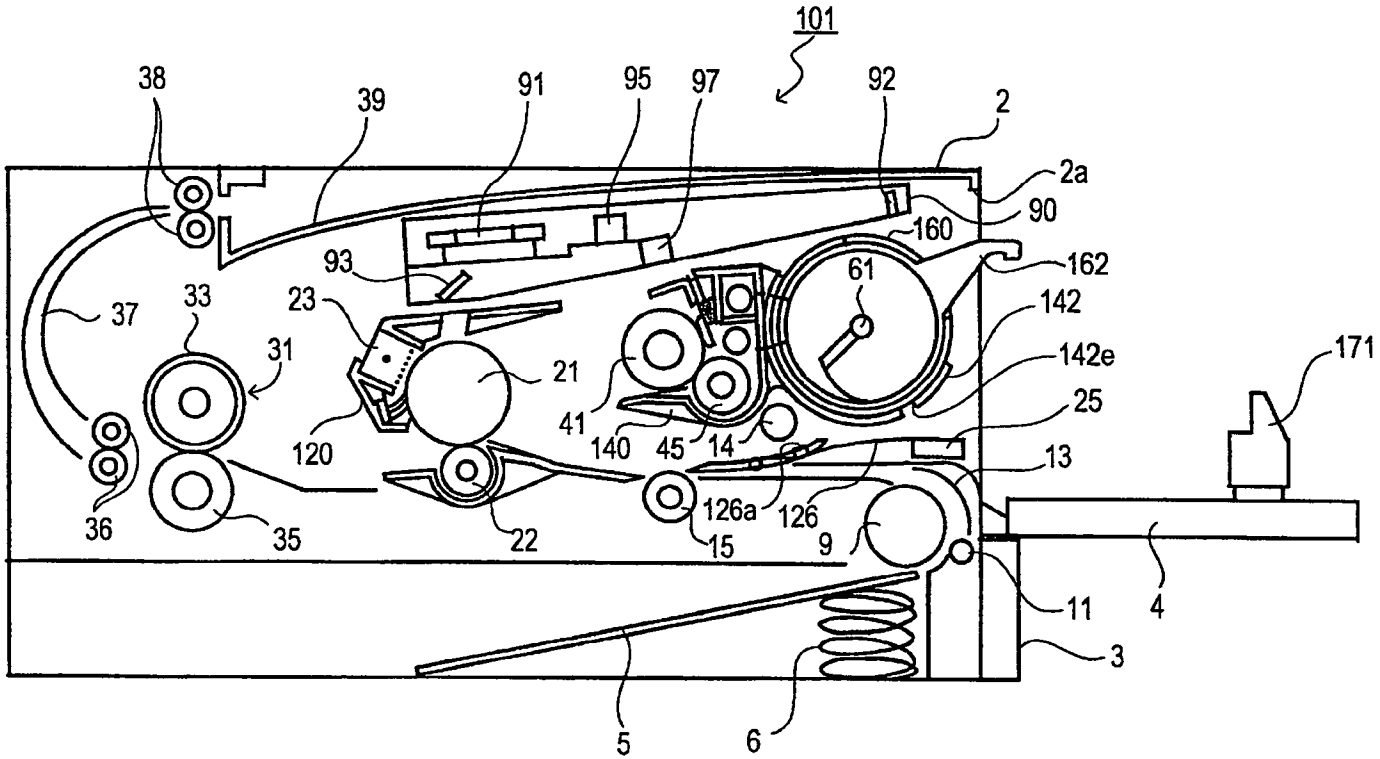
FIG. 16 is a vertical cross sectional diagram showing an operation of removing the developing cartridge and a toner cartridge of the laser printer in an integrated manner.
Figure 17A:
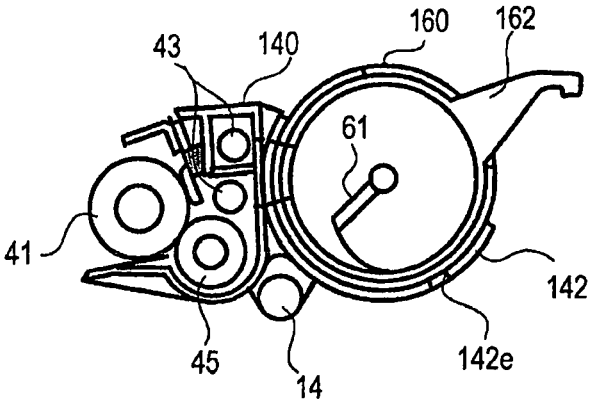
FIG. 17A is a vertical cross sectional diagram showing operation of separating the toner cartridge and the developing cartridge of the laser printer.
Figure 17B:
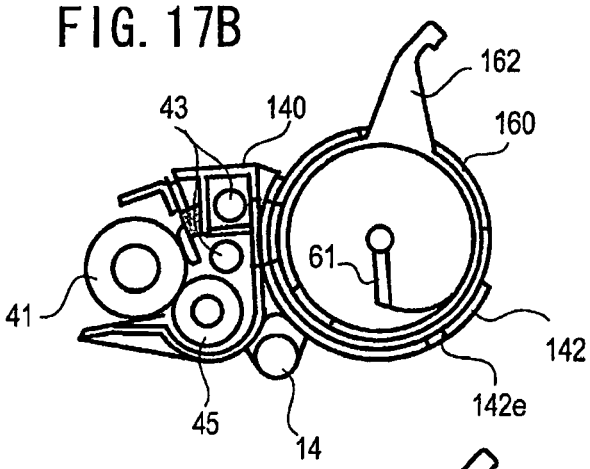
FIG. 17B is a vertical cross sectional diagram showing operation of rotating a handle directly to the above for separating the toner cartridge and the developing cartridge of the laser printer.
Figure 17C:
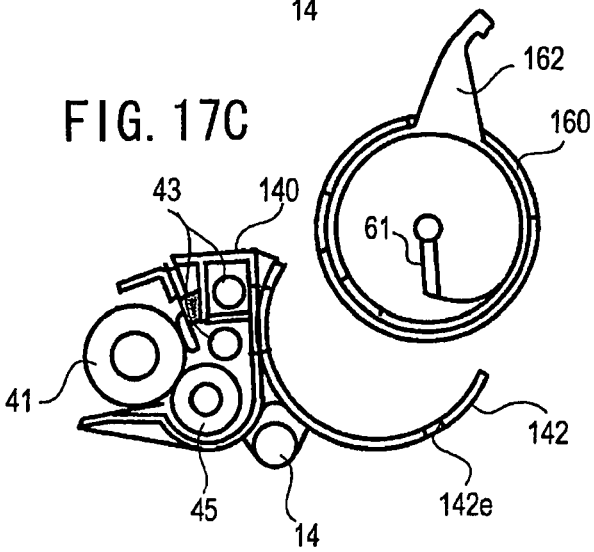
FIG. 17C is a vertical cross sectional diagram showing a state in which the toner cartridge and the developing cartridge of the laser printer are separated.

FIG. 17A shows the developing cartridge 140 and the toner cartridge 160 taken out as shown in FIG. 16. A connection and separation between the developing cartridge 140 and the toner cartridge 160 are switched over by a mechanism similar to the laser printer 1. The developing cartridge 140 and the toner cartridge 160 are separated when the handle 162 is rotated to a directly above direction as shown in FIG. 17B. In this state, when the toner cartridge 160 is pulled upwardly by holding the handle 162, the toner cartridge 160 is separated from the developing cartridge 140 as shown in FIG. 17C. Thereby, exchange of the toner cartridge 160 can be carried out.

In addition, as shown in FIG. 17B, when the developing cartridge 140 and the toner cartridge 160 are attempted to mount in the device body while the developing cartridge 140 and the toner cartridge 160 are separated, the handle 162 interferes with the scanner unit 90. Therefore, in the present embodiment as well, the device is prevented from driving while the developing cartridge 140 and the toner cartridge 160 are separated.

Figure 18:
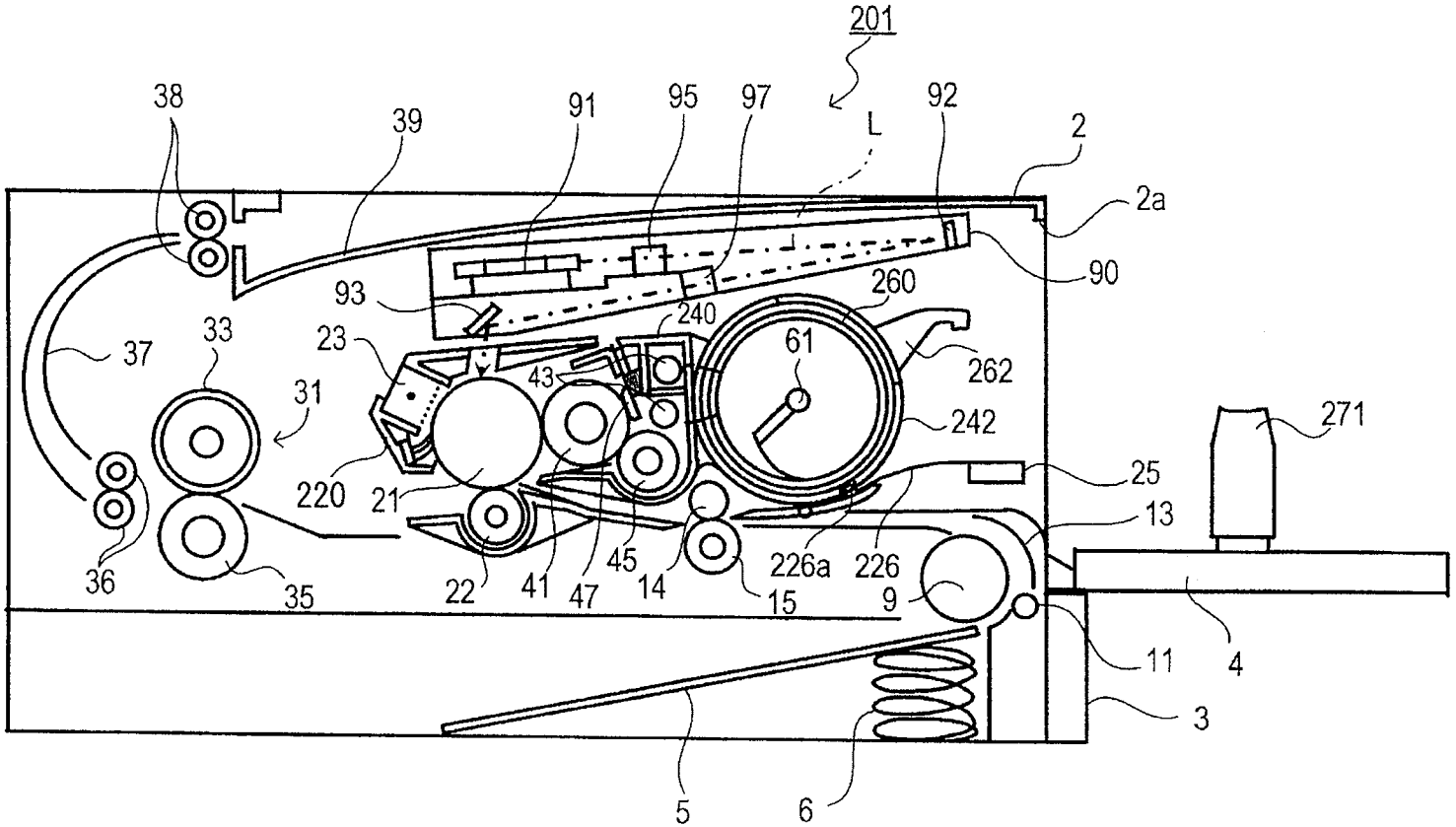
FIG. 18 is a vertical cross sectional diagram showing a configuration of a laser printer according to a third embodiment.

FIG. 18 is a vertical cross sectional diagram showing a configuration of a laser printer 201 according to a third embodiment of the present invention. The laser printer 201 is different from the laser printer 1 in a point that a supporting unit 242 is provided in the developing cartridge 240. The supporting unit 242 has a cylindrical shape surrounding an outer periphery of the toner cartridge 260 to support the toner cartridge 260. In accordance therewith, a hole 242*e* (see FIG. 19) is formed on the supporting unit 242 similar to the laser printer 101. A plate spring 226 connecting the handle 25 to a photosensitive member cartridge 220 is provided with a protrusion 226*a* which fits into the hole 242*e*.

In addition, a handle 262 of the toner cartridge 260 is provided on an upper portion of the toner cartridge even when the handle 262 is provided at the connecting position shown in FIG. 18. Further, the handle 262 protrudes from a left end (right end as viewed from a front side) of the supporting unit 242 as shown in FIGS. 20A to 20F described later. In addition, the lid portion 4 is provided with a pressing member 271 which directly presses a surface in the front portion of the supporting unit 242. Similar to the laser printer 101, the spring receiving unit 66 or the interfering member 72 are not provided.

In the laser printer 201 as well, after the lid portion 4 is opened and the handle 25 of the photosensitive member cartridge 220 is pulled in a front direction, the photosensitive member cartridge 220, the developing cartridge 240, and the toner cartridge 260 can be removed in an integrated manner from the mounting/removing opening 2*a* to outside the device body of the laser printer 201.

Figure 19:
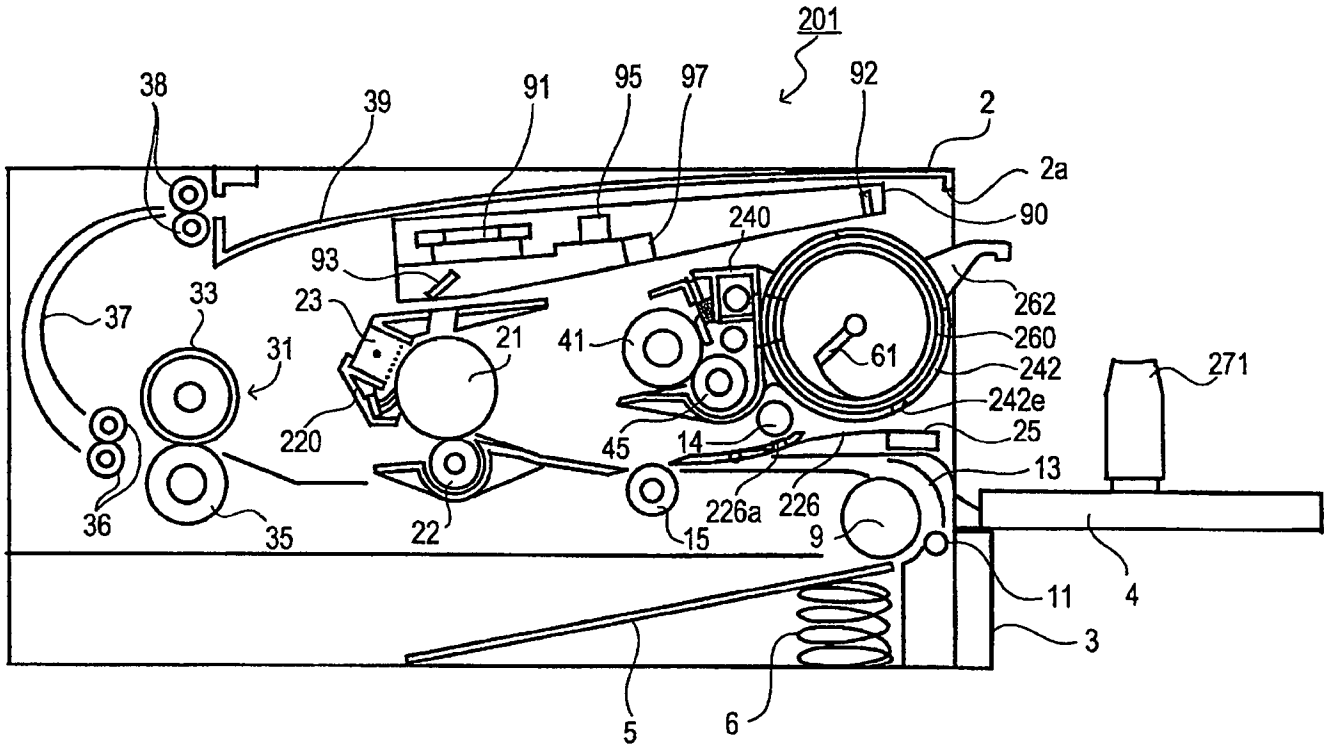
FIG. 19 is a vertical cross sectional diagram showing operation of removing a developing cartridge and a toner cartridge of the laser printer in an integrated manner.

In addition, when the handle 25 of the photosensitive member cartridge 220 is pressed down, the developing cartridge 240 is separated from the photosensitive member cartridge 220. Further, when the handle 262 of the toner cartridge 260 is pulled in a front direction as-is, the toner cartridge 260 and the developing cartridge 240 can be removed from the mounting/removing opening 2*a* to outside the device body as shown in FIG. 19.

Figure 20A:
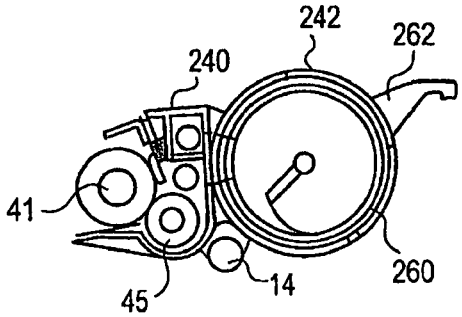
FIG. 20A is a vertical cross sectional diagram showing an operation of separating the toner cartridge and the developing cartridge of the laser printer.
Figure 20B:
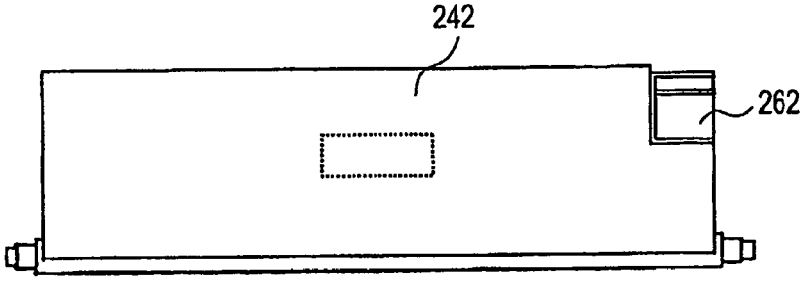
FIG. 20B is a front view showing operation of separating the toner cartridge and the developing cartridge of the laser printer.
Figure 20C:
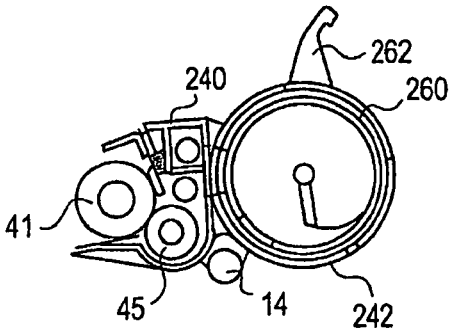
FIG. 20C is a vertical cross sectional diagram showing a state in which the handle is rotated directly to the above in order to separate the toner cartridge and the developing cartridge of the laser printer.
Figure 20D:
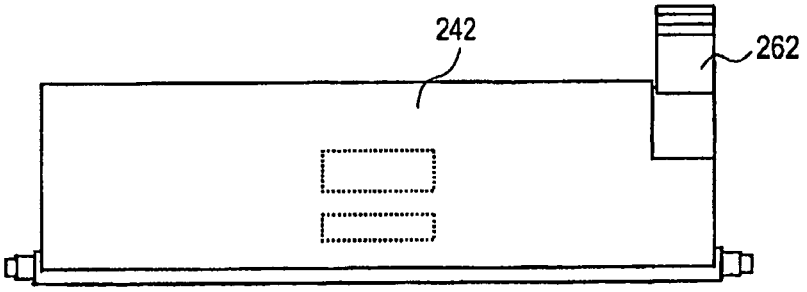
FIG. 20D is a front view showing a state in which the handle is rotated directly above in order to separate the toner cartridge and the developing cartridge of the laser printer.
Figure 20E:
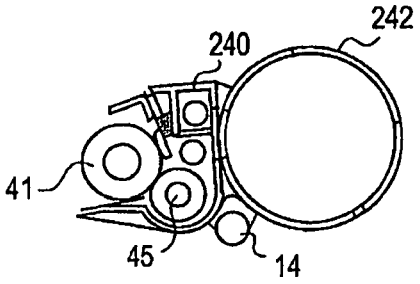
FIG. 20E is a vertical cross sectional diagram showing a state in which the toner cartridge of the laser printer is pulled out from the developing cartridge.
Figure 20F:
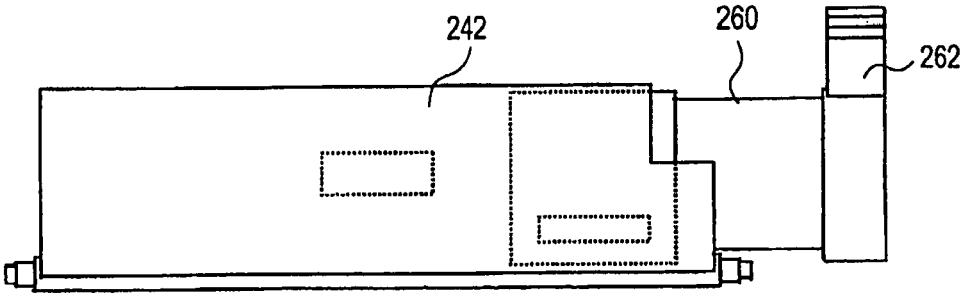
FIG. 20F is a front view showing a state in which the toner cartridge of the laser printer is pulled out from the developing cartridge.

FIGS. 20A and 20B show a vertical cross sectional diagram and a front view of the developing cartridge 240 and the toner cartridge 260 is removed as described above. A connection and separation between the developing cartridge 240 and the toner cartridge 260 are switched over by a mechanism similar to the laser printer 1. The developing cartridge 240 is disengaged from the toner cartridge 260 when the handle 262 is rotated to a directly above direction as shown in FIGS. 20C and 20D. In this state, when the toner cartridge 260 is pulled to a side direction by holding the handle 262, exchange of the toner cartridge 260 can be carried out as shown in FIGS. 20E and 20F.

So far, embodiments of the present invention have been described. In the above embodiments, the handles 25, 62, 162, and 262 correspond to an operation unit, and the guide grooves 20*b* and 42*d* correspond to a guide. The image forming device according to the present invention are not limited to the embodiments described above. Various modifications and changes can be made without departing from the scope of the inventions. For example, the photosensitive member cartridge, the developing cartridge, and the toner cartridge may be removed outside the device body in an integrated manner and then separated into individual cartridges. In addition, in the laser printer 1, the rotational shafts 903 and 905 are guided by the guide grooves 42*b* and 20*b*. However, the toner cartridge 60 or the developing cartridge 40 may include protruding shaft members parallel to the rotational shafts 903 and 905, and thereby the shaft members may be guided in a similar manner as the rotational shafts 903 and 905.

What is claimed is:

1. An image forming apparatus comprising:

a main body having a loading port;

an image bearing unit having a photosensitive drum;

a paper feeding cassette being mounted to a lower part of the main body;

a developer unit having a developing roller configured to develop an electrostatic latent image formed on the photosensitive drum;

a toner unit configured to accommodate toner therein, the toner unit having an agitator configured to agitate the toner, the toner unit configured to be detachably attached to the developer unit through the loading port, wherein the toner unit, the developer unit, and the image bearing unit are arranged in this order in an arrangement direction from the loading port to an inside of the main body, when the toner unit, the developer unit, and the image bearing unit are attached in the main body, and wherein the toner unit having the agitator is configured to be independently detached from the developer unit through the loading port while the developer unit remains attached to the image bearing unit in the main body; and a lid portion provided at a front surface of the main body, the lid portion including a hinge, the hinge being positioned between the toner unit attached in the main body and the paper feeding cassette, the lid portion being open around the hinge, and the lid portion configured to be in:

an open state in which the toner unit is allowed to be detached through the loading port; and a closed state in which the lid portion covers the loading port, wherein the lid portion includes a pressing member configured to contact and press the toner unit toward the inside of the main body in the arrangement direction in a case where the lid portion is in the closed state, wherein the pressing member is configured to be in contact with the toner unit in a state where the toner unit is attached to the developer unit, wherein the pressing member is configured to press the developer unit toward the image bearing unit via the toner unit in a state where the toner unit is attached to the developer unit, wherein the developer unit includes a rail, wherein the toner unit includes an inner cylinder and an outer cylinder, the inner cylinder includes an engaging portion, wherein the developer unit is connected to the toner unit by engagement of the engaging portion and the rail, and wherein in a case where the toner unit is attached to the developer unit in the main body and then the toner unit is rotated, the engaging portion and the rail are disengaged one from another and the toner unit is separated from the developer unit.

2. The image forming apparatus according to claim 1, wherein the toner unit includes a handle configured to be in:

a first state in which the handle is positioned at a first position; and a second state in which the handle is positioned at a second position, wherein the lid portion is in the closed state in a case where the handle is in the first position, and wherein the handle interferes with the lid portion in a case where the lid portion is in the open state and the handle is in the second position.

3. The image forming apparatus according to claim 1, further comprising a fixing unit configured to fix toner, the fixing unit being positioned inside of the main body, wherein the toner unit, the developer unit, the image bearing unit, and the fixing unit are located in this order in the arrangement direction from the loading port to an inside of the main body.

4. The image forming apparatus according to claim 1, further comprising a fixing unit configured to fix toner, the fixing unit being positioned inside of the main body, wherein the pressing member is configured to press the toner unit toward the fixing unit.

5. The image forming apparatus according to claim 4, wherein the toner unit, the developer unit, the image bearing unit, and the fixing unit are located in this order in the arrangement direction, and wherein the pressing member is configured to press the toner unit toward the fixing unit in the arrangement direction in a case where the lid portion is in the closed state.

6. The image forming apparatus according to claim 1, wherein the pressing member is configured to be in contact with the toner unit and configured to press the developer unit toward the inside of the main body via the toner unit in a case where the lid portion is in the closed state.

7. The image forming apparatus according to claim 1, further comprising a fixing unit configured to fix toner, the fixing unit being positioned inside of the main body, wherein the pressing member is configured to be in contact with the toner unit and configured to press the developer unit toward the fixing unit via the toner unit in a case where the lid portion is in the closed state.

8. The image forming apparatus according to claim 7, wherein the toner unit, the developer unit, the image bearing unit, and the fixing unit are located in this order in the arrangement direction, and wherein the pressing member is configured to press the developer unit toward the fixing unit in the arrangement direction via the toner unit in a case where the lid portion is in the closed state.

9. The image forming apparatus according to claim 1, further comprising a paper discharge tray positioned above the lid portion, wherein the paper feeding cassette is positioned below the lid portion.

10. The image forming apparatus according to claim 9, wherein the hinge is positioned closer to the paper feeding cassette than the paper discharge tray, and wherein the lid portion is pivotable about the hinge.

11. The image forming apparatus according to claim 1, wherein the developing roller includes a rotational shaft, and wherein the image bearing unit includes a guide groove configured to guide the rotational shaft, the guide groove extending in the arrangement direction.

12. The image forming apparatus according to claim 1, wherein the lid portion includes a plurality of the pressing member, wherein the toner unit has a handle, and wherein the handle is positioned between one of the plurality of the pressing member and another of the plurality of the pressing member in a case where the lid portion is in the closed state.

13. The image forming apparatus according to claim 1, wherein, in a case where the toner unit, the developer unit, and the image bearing unit are attached in the main body and the lid portion shifts from the closed state to the open state, the lid portion moves in a downward direction from the toner unit attached in the main body to the paper feeding cassette.

14. The image forming apparatus according to claim 1, wherein the inner cylinder is rotatably disposed on the outer cylinder, and wherein in a case where the toner unit is attached to the developer unit in the main body and then the inner cylinder is rotated, the engaging portion and the rail are disengaged one from another and the toner unit is separated from the developer unit.

* * * * *